US005322284A

United States Patent [19]

El-Agamawi

[11] Patent Number: 5,322,284

[45] Date of Patent: Jun. 21, 1994

[54] CHANGEABLE CONFIGURATION PUZZLE GAME

[76] Inventor: Mohsen M. El-Agamawi, 2709 Stonecliffe Dr., Monroeville, Pa. 15146

[21] Appl. No.: 764,190

[22] Filed: Sep. 23, 1991

[51] Int. Cl.[5] ..... A63F 9/08; A63H 33/04

[52] U.S. Cl. ..... 273/157 R; 273/159; 446/487

[58] Field of Search ..... 273/153 R, 153 S, 155, 273/157 R, 158, 159; 446/104, 111, 112, 113, 487

[56] References Cited

U.S. PATENT DOCUMENTS

| | | | |
|---|---|---|---|
| 4,142,321 | 3/1979 | Coppa | 273/155 |
| 4,392,323 | 7/1983 | Rubik | 446/487 |
| 4,722,712 | 2/1988 | McKenna | 273/155 |
| 5,046,988 | 9/1991 | Bennett | 446/487 |
| 5,108,100 | 4/1992 | Essebaggers et al. | 273/159 |

FOREIGN PATENT DOCUMENTS

| | | | |
|---|---|---|---|
| 1417901 | 8/1988 | U.S.S.R. | 273/155 |
| 2107200 | 4/1983 | United Kingdom | 273/155 |
| 2108395 | 5/1983 | United Kingdom | 273/155 |

*Primary Examiner*—Vincent Millin
*Assistant Examiner*—Steven B. Wong
*Attorney, Agent, or Firm*—Buchanan Ingersoll

[57] ABSTRACT

The device utilizes a changeable-configuration geometric arrangement including a plurality of units, such as tetrahedrons, connected together at points by means of joints. The tetrahedrons can be equally divided into two different types of units that are exact mirror images of each other. The unit in each type has four triangular faces. The units along with the joints form an articulated chain in which any two adjacent units are of different types. The assembly of any two units connected together with a joint allows both units to rotate relative to each other in all directions around the center of the joint. In the articulated device, six consecutive units can be used to form the configuration of a cube. Different coloring and/or numbering schemes can be used to provide different levels of complexity and challenge for the puzzle. Units can be formed as right tetrahedrons having two faces with side lengths generally equal to (L, $\sqrt{2}$ L, $\sqrt{3}$ L), and two faces with side lengths generally equal to (L, L, $\sqrt{2}$ L).

60 Claims, 30 Drawing Sheets

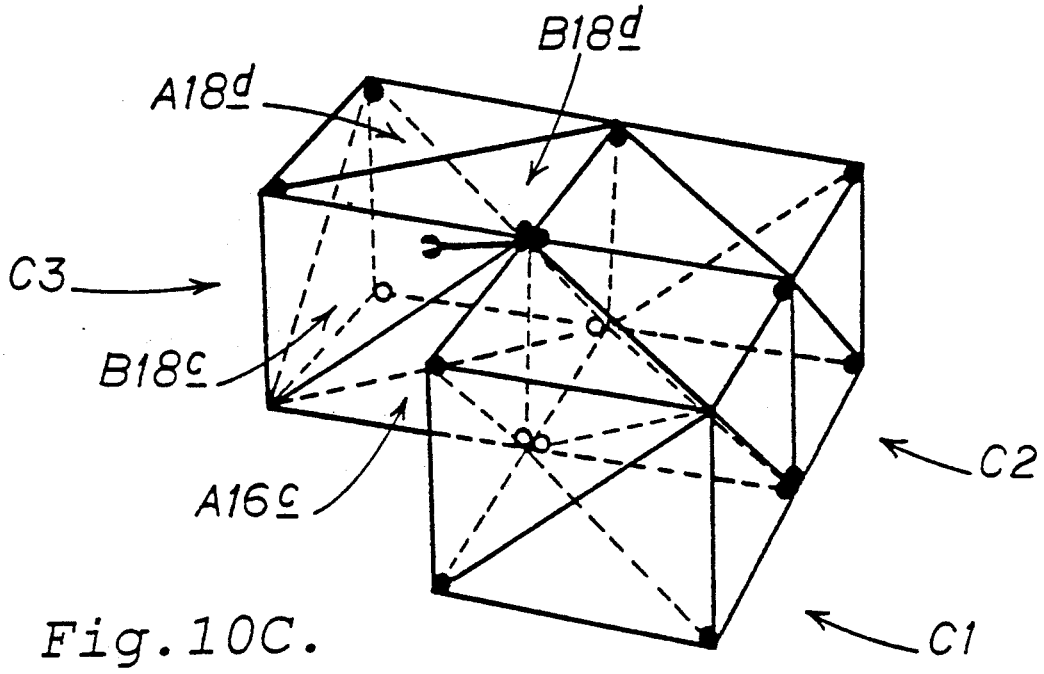
Fig. 10C.
Fig. 10D.
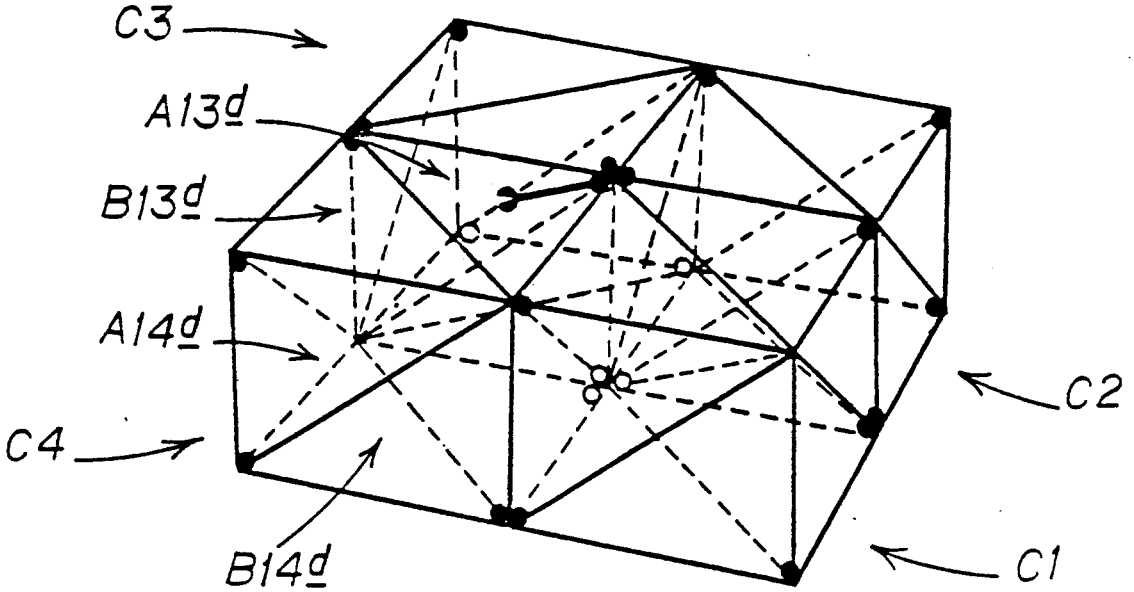

CHANGEABLE CONFIGURATION PUZZLE GAME

BACKGROUND OF THE INVENTION

The present invention relates to a manipulative type puzzle involving manipulation of a changeable-configuration geometric device. Prior arrangement of three dimensional structures to form geometric puzzles included "Rubik's Cube", and similar changeable-configuration structures such as that shown in U.S. Pat. No. 4,063,725. The "Rubik's Cube" device permits only limited movement of any specific smaller cube, usually only rotational movement in the plane of the face of the formed cube, and then only when all smaller cubes forming such face are rotated. Similarly the device in the 4,063,725 patent hinges tetrahedrons along adjoining edges to form a larger cube. While such structures may be formed in many various ways, Rubik's Cube puzzles, are limited to forming a cube. The variations in such puzzles are not in the geometric structure formed but in how such formed structure is compiled. The restricted movement of the joinder between individual elements create limitations on the final configured shape can be created.

Such an articulated structures hold a great deal of interest for both children and adults as a challenging puzzle and also as an amusement.

SUMMARY OF THE INVENTION

The invention includes a chain-like arrangement of three dimension units, presently preferred units are tetrahedron shaped and connected together by joints. Manipulation of the units permits the construction of larger configurations such as cubes and pyramids. The joints are preferably connected at the points of the units to permit any face adjacent the joint point of a unit to be moved into contact with a face on the next sequential unit. Mirror image tetrahedrons alternative interconnected in the chain-like arrangement can further be enhanced by color or numerical coding of the respective faces of each unit. Presently preferred joints provide a central hinge and the ability to rotate each extending arm within the unit to provide the desired degrees of movement of the joint. Hemispherical heads on the joint arms retain the joints in the units and permit easy disassembly when desired.

In one embodiment a device is formed as an articulated structure including forty-eight right tetrahedra connected together by forty-seven joints in such a manner that every two connected right tetrahedra may swing and rotate freely relative to each other around the connection point. The forty-eight tetrahedra are equally divided into two types of units, unit A and unit B. The two units are an exact mirror image of each other. One configuration of the articulated device is in the form of a chain of connected units where any two adjacent units are of different types.

One specific geometric unit is particularly advantageous in such a device and provides certain unique structural construction. The preferred unit is a right tetrahedra having four faces composed of two right triangles each having respective side lengths (L, $\sqrt{2}$ L, $\sqrt{L}$), and (L, L, $\sqrt{2}$ L). This particular unit and its mirror image tetrahedron provide multiple configurations with a small number of total units such as, for example, a hollow pyramid of height 2L, and a solid cube of side length 2L. Such units may be joined in a serial arrangement so as to foldably form such configurations.

There are at least two unique configurations that can be formed by the device, one configuration is an equilateral cube and the other is a four-sided pyramid. These two configurations form the special use for this articulated device as a puzzle. In addition, as will be explained, part of the chain forming the articulated device may be constructed in a larger scale for children's playground-type equipment, capable of forming a variety of configurations.

A general object of this invention is to provide an articulated device which has different uses at different levels of complexity. One particular use, described herein, is as a manipulative puzzle. One solution of the puzzle is to form an equilateral cube. The cube is solidly composed of eight smaller cubes. All of the smaller cubes are identical and each is formed from six consecutive units of the articulated device. A more interesting solution in the manipulative puzzle is to form the configuration of a four-sided pyramid. The pyramid has four similar triangular faces and a square base. The base side length is equal to twice the height of the pyramid. There is a hollow space located inside the pyramid. The volume of that hollow space is equal to the volume of sixteen units.

A further object of the articulated device of the invention is to provide other puzzles of higher degrees of difficulty and complexity by increasing the number of units included in the chain device. Geometric configurations of larger equilateral cubes and larger four-sided pyramids are obtainable from longer chain devices. The longer chain device consists of a larger number of units connected in a similar order in which the units are connected in the previously described embodiment of the chain device.

Another object is to provide a puzzle that can utilize a large number of similar units to form a variety of configured structures. In the presently preferred embodiments only two mirror image units can be joined by a common type joint to form puzzles having upward of 128 individual building units, but assemble from only a series of three basic components.

It will be apparent in later description of the manipulation of the articulated device of the invention that forming of the four-sided pyramid configuration is a truly interesting and challenging puzzle. The challenge in solving this puzzle emerges from the fact that all units included in the articulated device are contributing to the construction of the pyramid surfaces, including the four side faces and the base. In other words it is impossible to build such a complete-surface pyramid if any of the units is misplaced in the hollow space inside the pyramid during the construction steps. Solutions for forming the configurations of both of the cube and the four-sided pyramid are provided in the following detailed description of the invention.

The complexity and difficulty of this puzzle can be simplified by the use of color and/or number indicia for various faces of each unit included in the articulated device. The use of such indicia means provides a guide for the user to solve the puzzle. It also allows for the design of different levels of complexity for the puzzle based on the choice of certain color and/or numerical relationships. An example of using color indicia for the pyramid puzzle is also provided in the detailed description of the embodiments.

BRIEF DESCRIPTION OF THE DRAWINGS

All the drawings have a similar top perspective view.

FIGS. 10A–10H show some configurations formed in the intermediate steps required to form the cube (shown in FIG. 6) using the articulated device 95 shown in FIG. 4.

DETAILED DESCRIPTION OF PREFERRED EMBODIMENTS

The changeable configuration device of the presently preferred embodiment pertains to an important feature of simplicity in structure. It consists of multiples of two types of units and one type of joint to connect all units together in the form of a chain. In addition, the two types of units are an exact mirror image of each other. While present preferred tetrahedral shaped units are generally solid, such units may also be constructed according to the invention which are hollow. The term tetrahedron refers to the exterior shape only. The two types of units are referenced as unit A and unit B. The basic arrangement of these three components in the structure of the device includes a unit A (A1), a unit B (B1), and a joint (J) are shown in FIG. 1 through FIG. 3.

Figure 1:
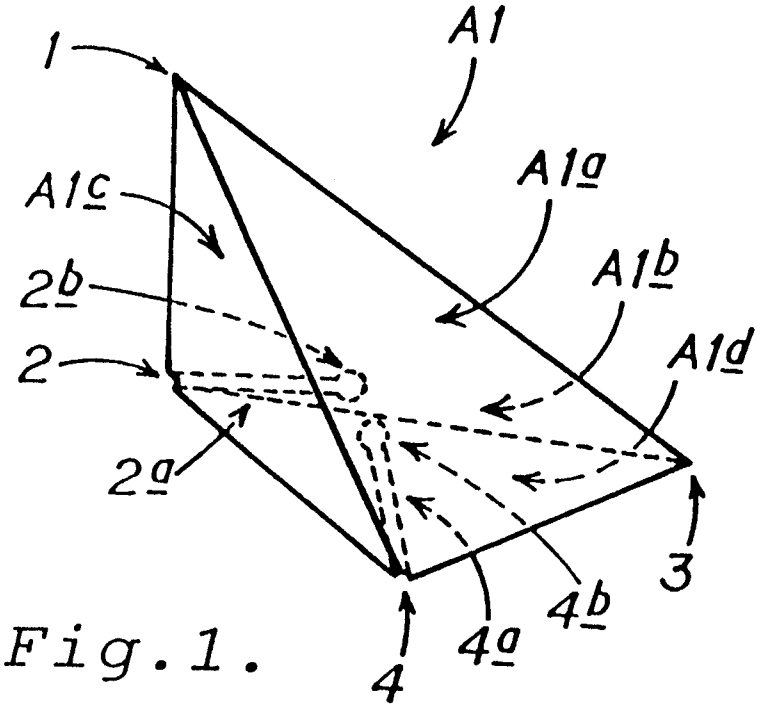
FIG. 1 shows one unit Al of the articulated device of a presently preferred embodiment of the invention. Unit Al is a right tetrahedron, with a cylindrical hole in each of two of its corners.

FIG. 1 shows the unit A1 of the device which is a solid right tetrahedron. Two of the faces are right triangles (having respective side lengths of L, $\sqrt{2}$ L, $\sqrt{3}$ L), indicated by A1a and A1b. The other two faces are right triangles (having side lengths of L, L, $\sqrt{2}$L), indicates by A1c and A1d. The tetrahedron A1 has four corners, each corner is the intersection point of three of its four triangular faces. Two of these four corners, indicated by 2 and 4, are the intersection points of the triangular faces at angles of generally 90.0, 90.0, and 45.0 degrees. Hereafter, such two corners are referred to by "right corner." The other two corners, indicated by 1 and 3, are the intersection points of the triangular faces at angles of generally 54.7356, 45.0 and 35.2644 degrees. Hereafter, such two corners are referred to by "sharp corner." Two cylindrical bores, indicated by **2*a* and 4*a*, are located at the right corners 2 and 4 respectively. Two spherical spaces, each with slightly larger diameter than the cylindrical bore diameter, indicated by 2*b* and 4*b*, are located at the end of the cylindrical bores 2*a* and 4*a***, respectively.

Figure 2:
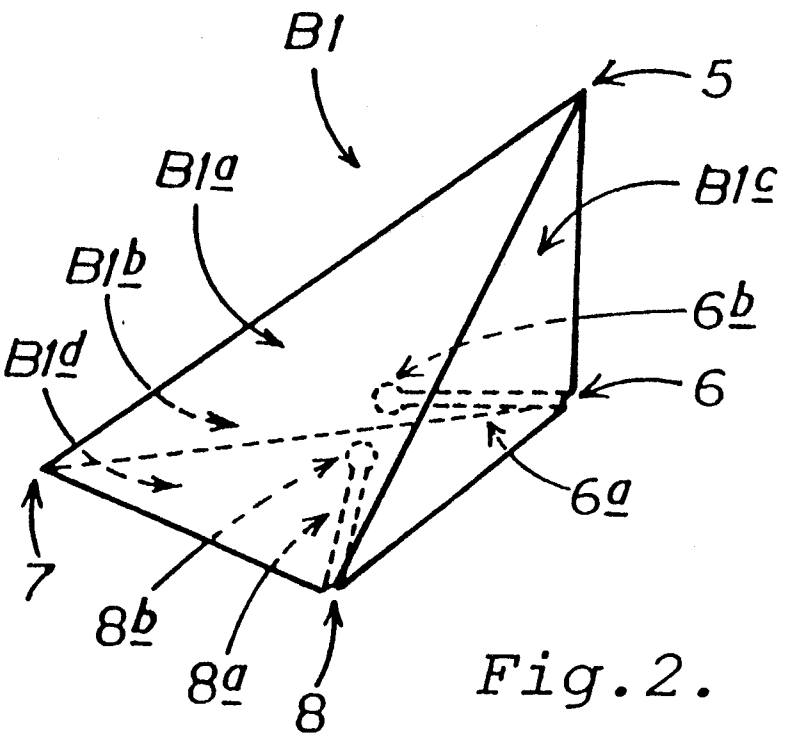
FIG. 2 shows one unit B1 of the articulated device of a presently preferred embodiment of the invention. Unit B1 is a right tetrahedron which is generally a mirror image of unit Al shown in FIG. 1.

FIG. 2 shows the right tetrahedron B1 which is an exact mirror image of A1 in FIG. 1. The four triangular faces of B1 are indicated by B1a, B1b, B1c, and B1d. The four corners are indicated by 5, 6, 7, and 8, where 6 and 8 are right corners and 5 and 7 are sharp corners. The cylindrical holes are indicated by **6*a* and 8*a*, and the respective spherical spaces are indicated by 6*b* and 8*b***.

Figure 3:
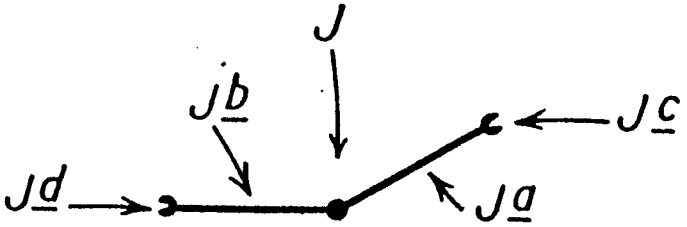
FIG. 3 shows the construction of a joint used in the presently preferred embodiment. All joints J can be of this type.

FIG. 3 shows a presently preferred design of the joint construction used in the articulated device 95, indicated by J. This joint consists of two connected arms, Ja and Jb. Where each arm is allowed to pivot around the other arm in a plane including both arms. The joint at the intersection of Ja and Jb may be of any type, such as a simple pivot using a threaded fastener, or a flexible hinge of molded elastomeric material. The ends of the two arms Ja and Jb are indicated by Jc and Jd respectively. At the end of each arm there are two generally hemispherical positions placed with a small angled space between their plane surfaces to form two jaws. The diameter of the two jaws is slightly larger than the diameter of the cylindrical hole and is slightly smaller than the hollow space at the end of the cylindrical hole. With some flexibility in the material of the two jaws, this design allows the insertion of the arms, Ja and Jb, inside the cylindrical holes of the units. The two jaws of Jd and Jc then expand in the spherical spaces, **4*b* and 8*b*, at the end of the holes 4 and 8. Such a design allows the rotation of the arms, Jb and Ja, inside the units, A1 and B1**, without disassembling the joint from the unit. In addition, the joint design allows an easy disassembling of the units by pulling them apart with some force in order to squeeze the two jaws at the end of the arm.

Figure 4:
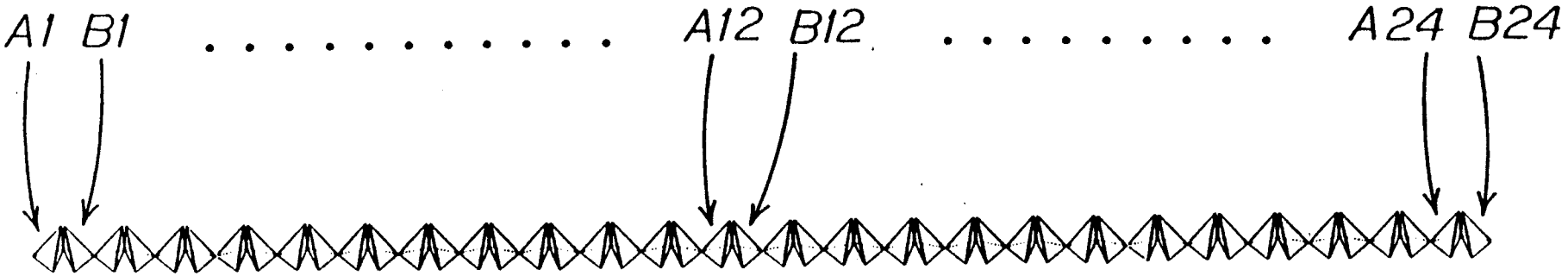
FIG. 4 shows an embodiment of the articulated device constructed in accordance with the present invention, in a reduced scale. This device forms the configuration of a chain consisting of twenty-four units of type A, indicated by A1 . . . A12 . . . A24; twenty-four units of type B, indicated by B1 . . . B12 . . . B24. Only references for pairs A1, B1 and A12, B12 and A24, B24 have been shown, but sequential references will be used for sequential pairs. Forty-seven joints which connect all adjacent units in the device. The complete chain-like arrangement is indicated by reference 95.
Figure 5:
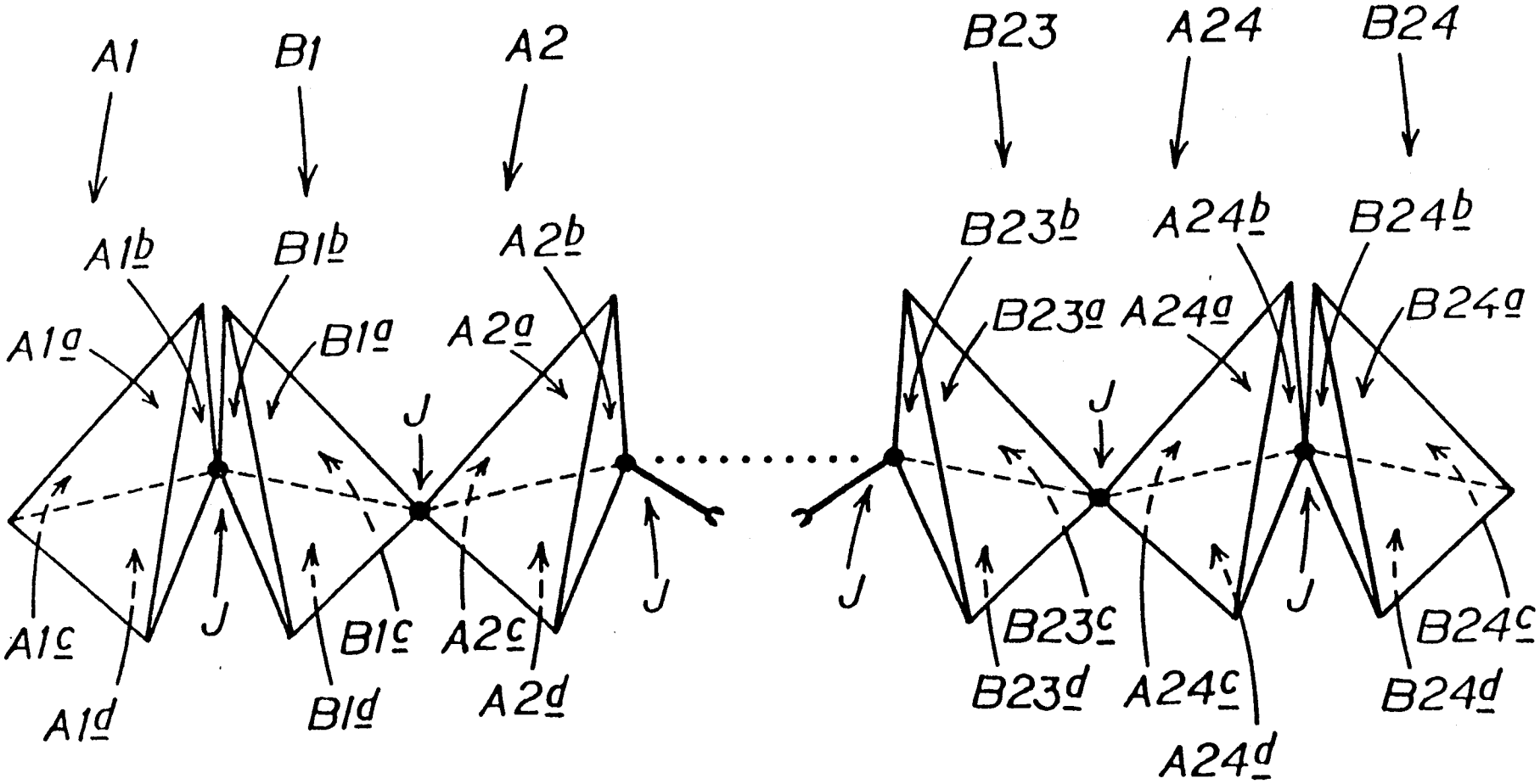
FIG. 5 shows in greater detail the device 95 of FIG. 4, including the leftmost three units and the rightmost three units. Each joint is indicated by J.
Figure 6:
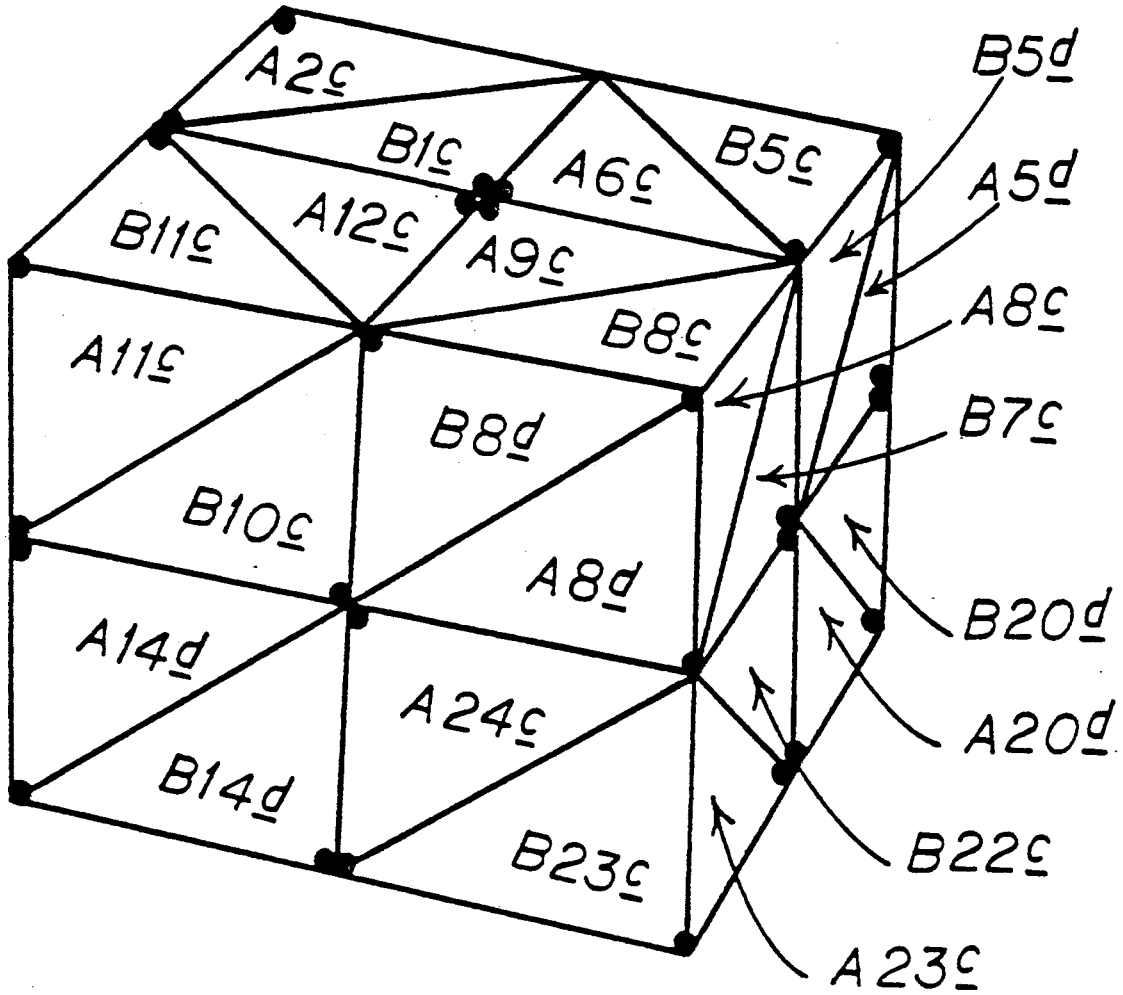
FIG. 6 shows a configuration of a cube formed from the device 95 of the invention of FIG. 4.
Figure 7:
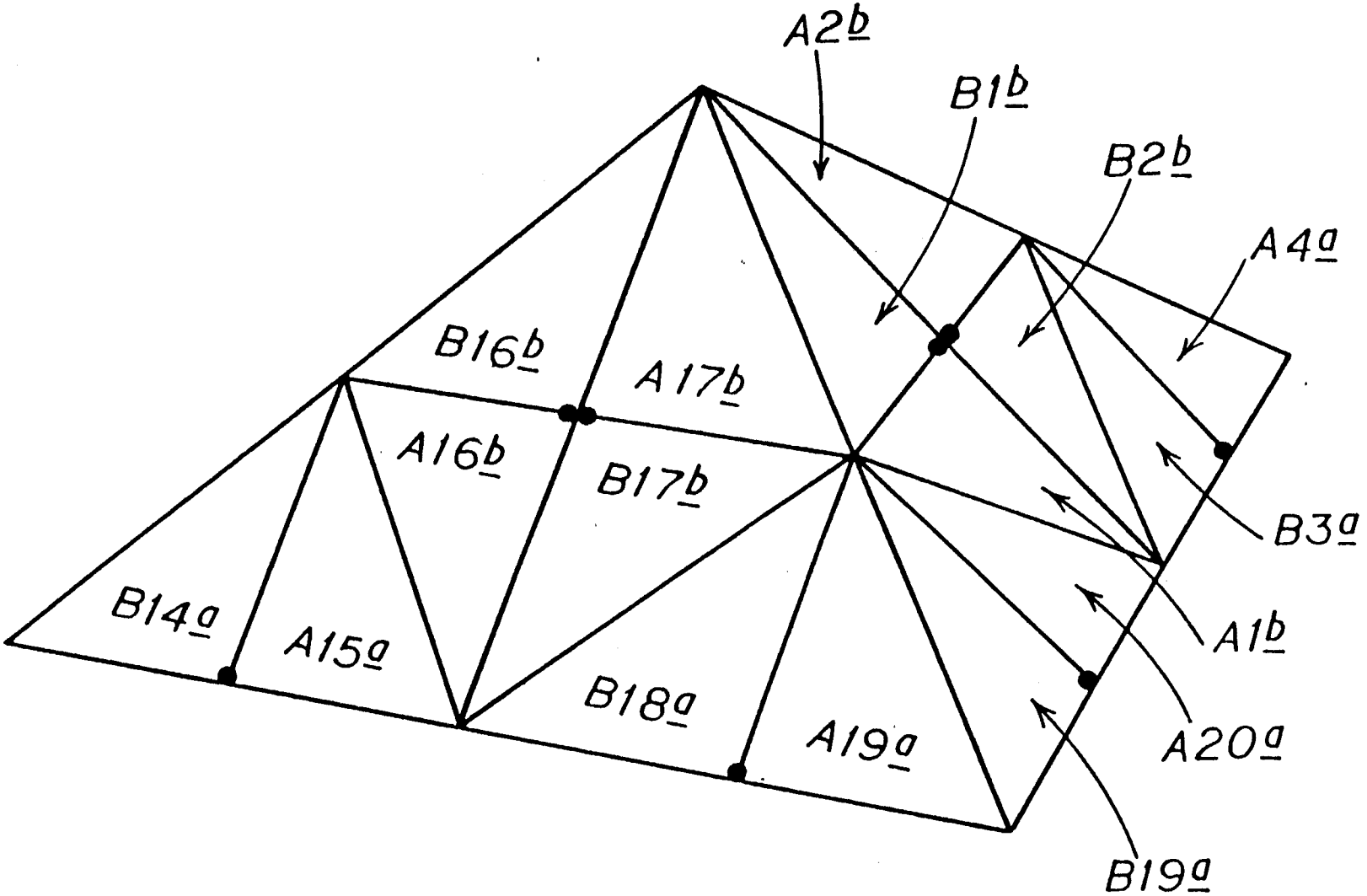
FIG. 7 shows a configuration of a four-sided pyramid formed from the device 95 shown in FIG. 4.

The articulated device shown in FIG. 4 uses a total of forty-eight units, twenty-four units similar to A1, A1–A24, and twenty-four units similar to B1, B1–B24, interconnected by forty-seven similar joints, J. The articulated device 95 forms a connected chain in the order A1, B1, A2, B2 through A23, B23, A24, B24, where any two adjacent units are of different types. The articulated device 95 is constructed from ninety-five components including forty-eight units of both types and forty-seven joints. FIG. 4 shows the device 95 in the configuration of a connected chain. FIG. 5 shows an enlarged scale of the device 95 of FIG. 4 with detailed description of the leftmost three units and the rightmost three units. The free arms of joints J in FIG. 5 represent the connection points to the rest of the units forming the articulated device. FIG. 6 shows the device 95 in the configuration of a 2 by 2 by 2 cube of side length 2L. FIG. 7 shows another configuration of the device 95 in the form of a four-sided pyramid of height 2L with a square base of side length 4L.

In the following figures are shown different configurations which may be formed using a partial number of the units included in the device 95. FIGS. 8A through 8F show different configurations obtained from the partial device consisting of units A1 and B1 connected by a joint, J. Different configurations of the two connected units are obtained by rotating one of the joint's arms inside the unit in addition to pivoting of the two arms around the connection point. Such movements of the two arms of a joint allow for all possible configurations of the two connected units. These configurations include bringing any of the three faces of one unit, surrounding one arm of the joint into contact with any of the three faces of the other unit, surrounding the other arm of the joint. The joint, J, provides freedom of movement to place any face that intersects the point where the connection is made to be placed adjacent any face on the next sequential unit that intersects the point of connection on that adjacent unit.

Figure 8A:
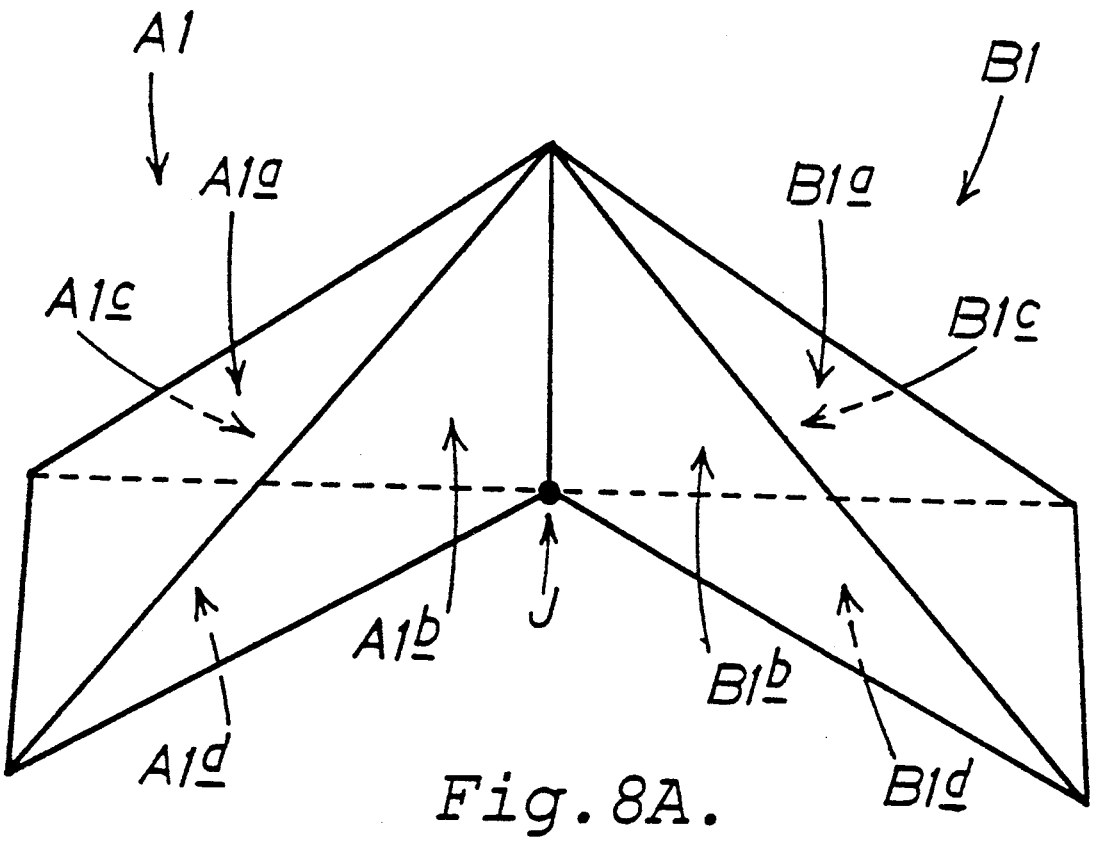
FIGS. 8A–8F show some configurations formed by a partial device consisting of the leftmost two units of the device 95 shown in FIG. 4, units A1, B1.
Figure 8B:
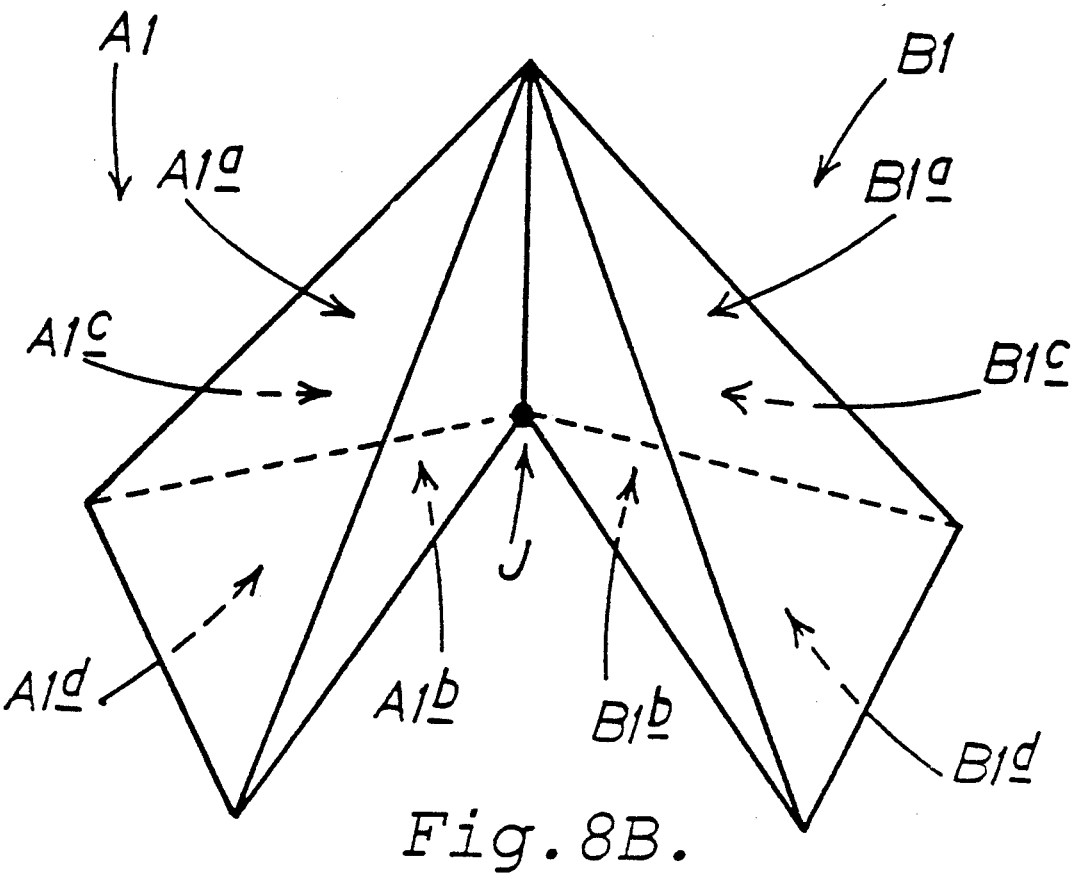
Figure 8C:
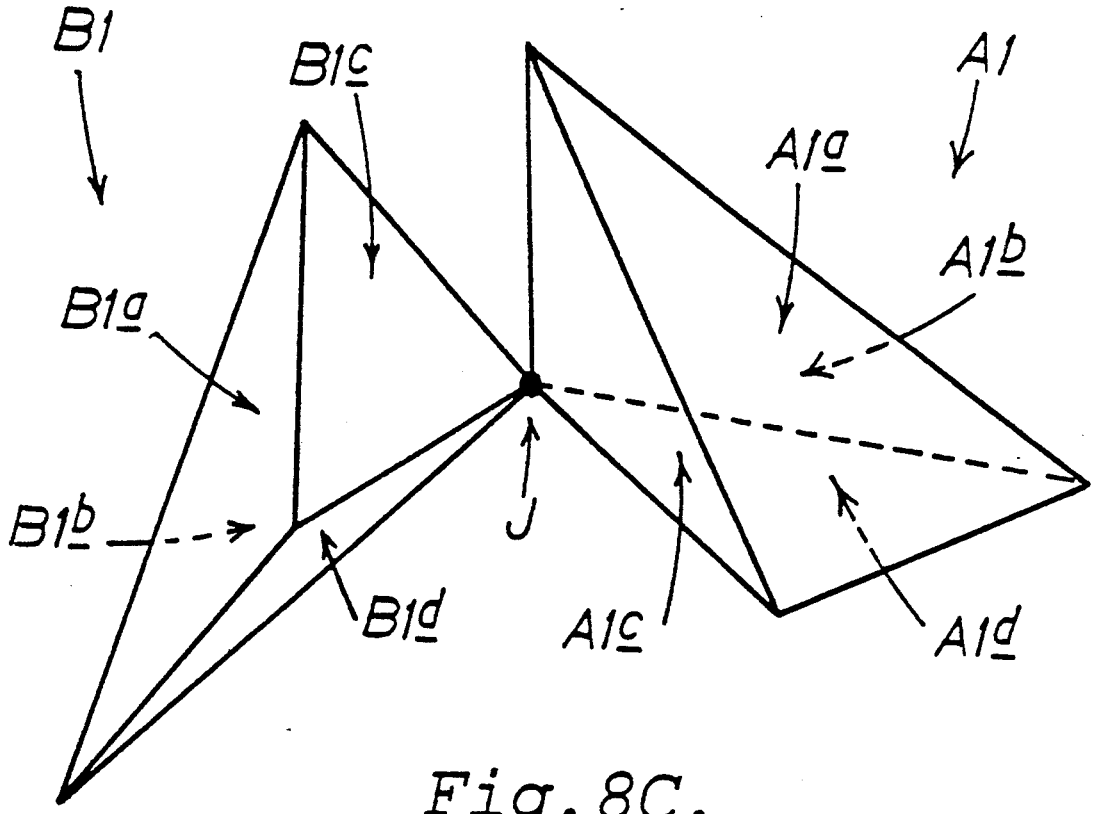
Figure 8D:
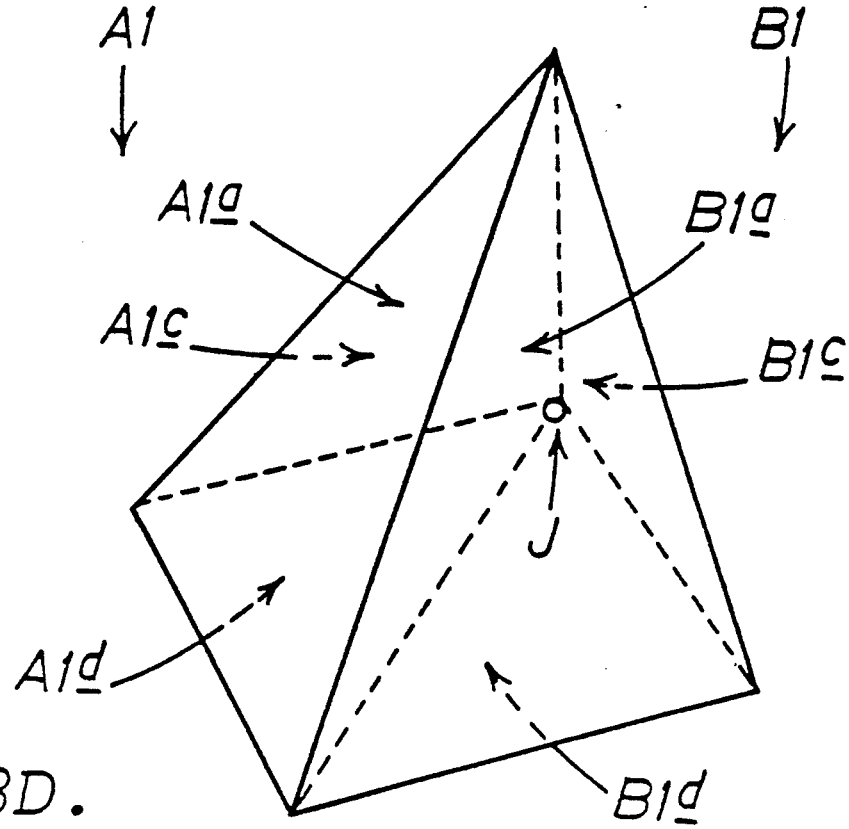
Figure 8E:
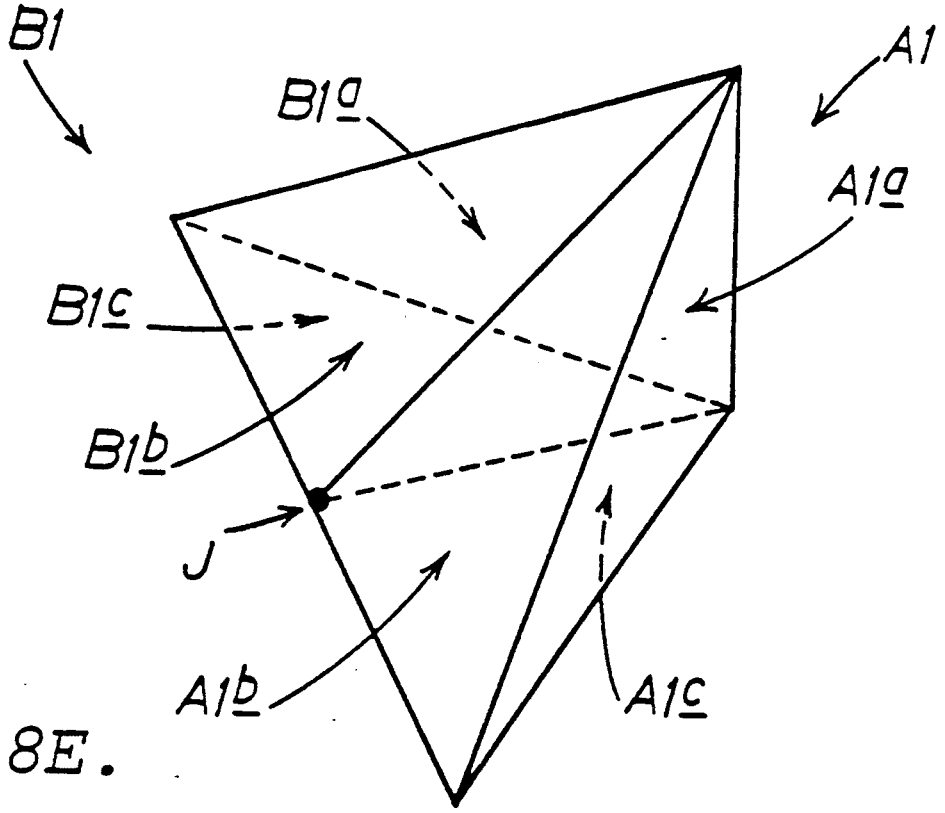
Figure 8F:
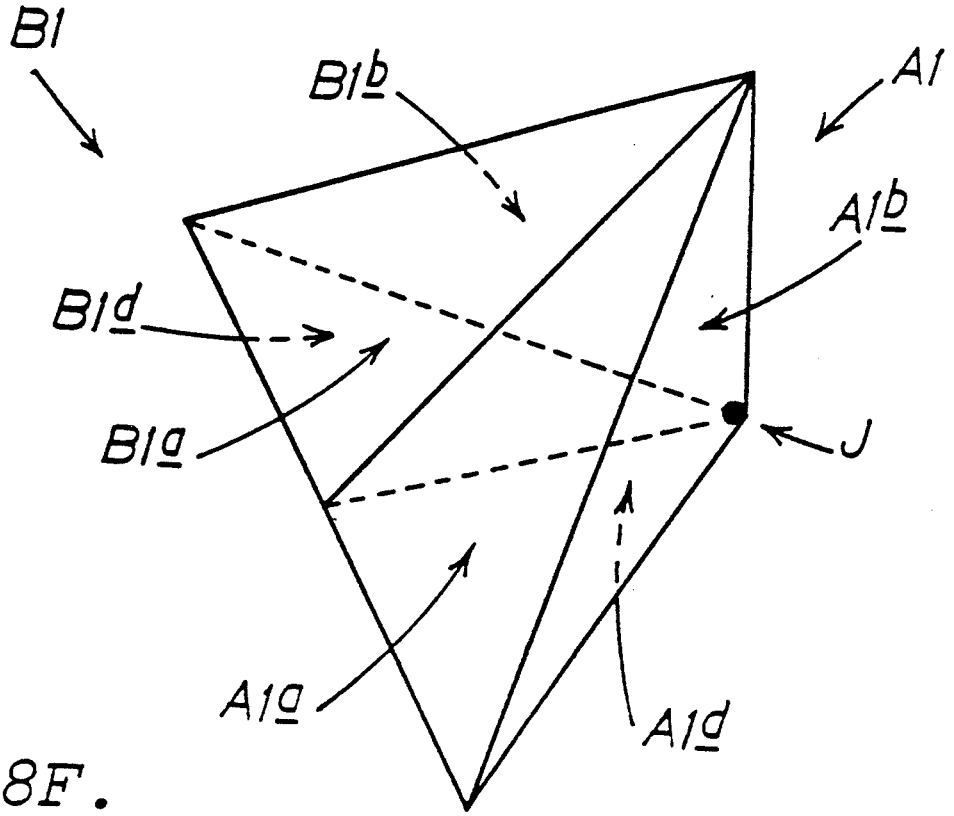

FIGS. 8D through 8F show three configurations of the partial device where there are two faces in full contact with each other. In these three figures there is a full symmetry around the plane of contact of the two faces. In these drawings, the faces which are in contact with each other are A1b with B1b, A1d with B1d, and A1c and B1c, respectively.

Figure 9A:
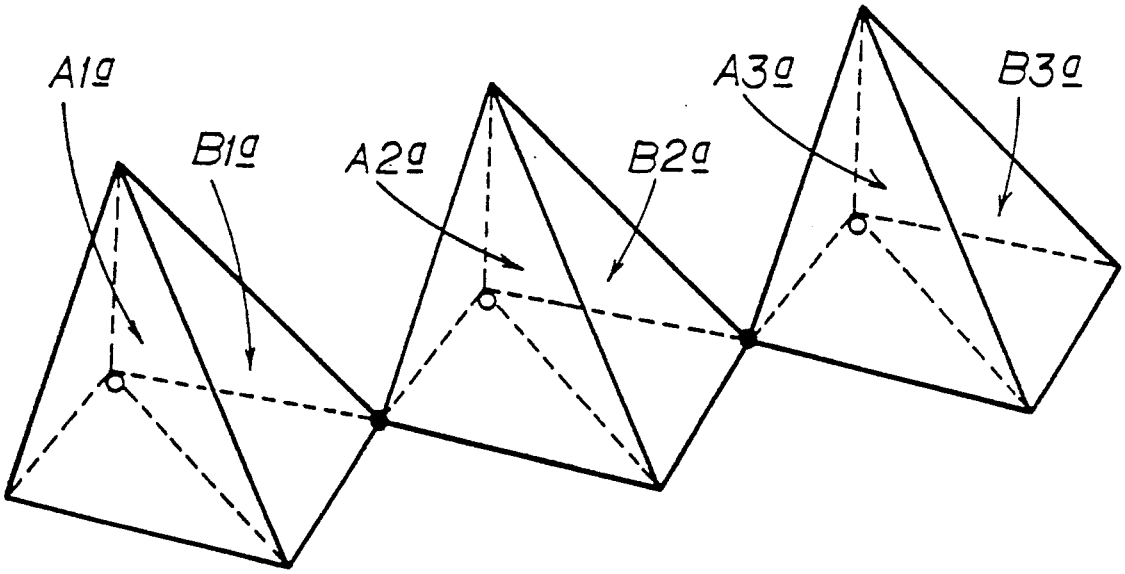
FIGS. 9A–9J show some configurations formed by a partial device consisting of the leftmost six units of the device 95 shown in FIG. 4, units A1, B1, A2, B2, A3, and B3.
Figure 9B:
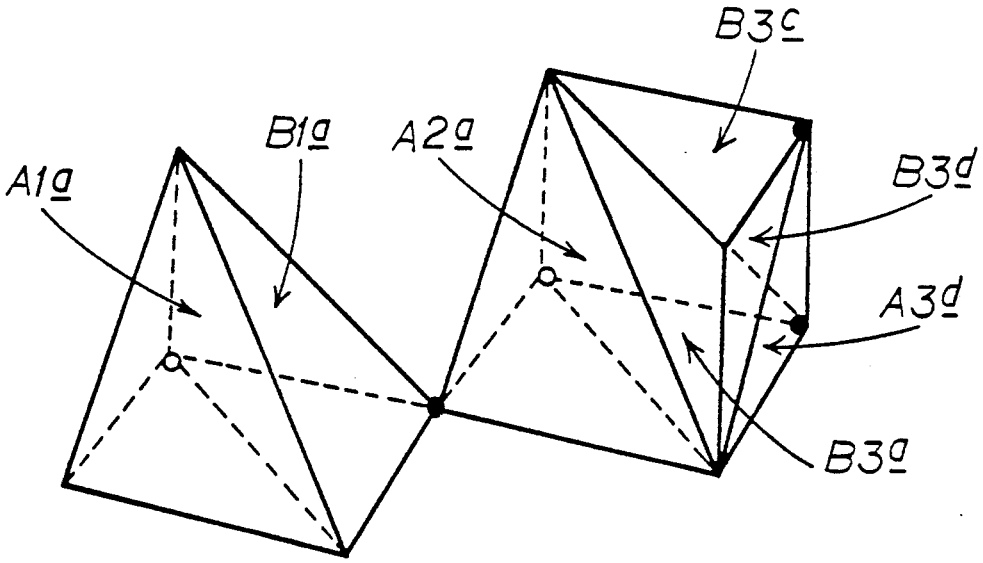
Figure 9C:
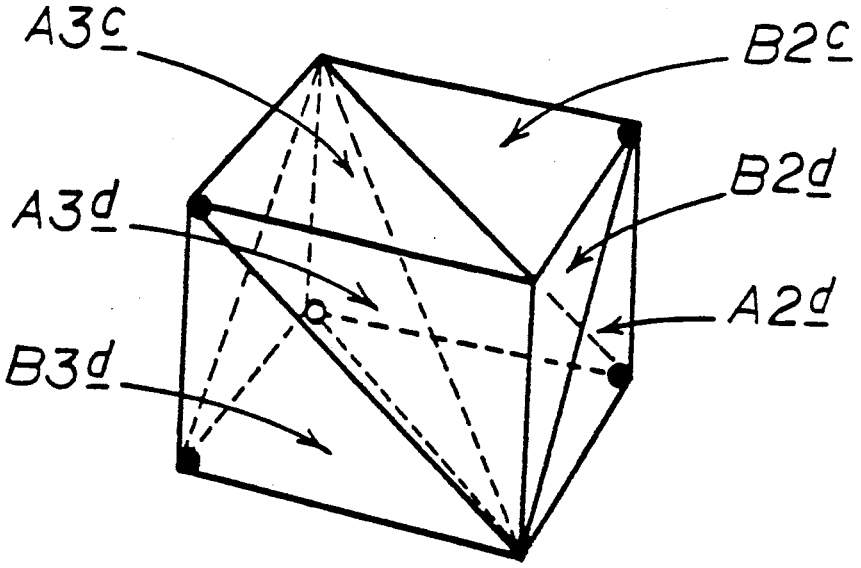
Figure 9D:
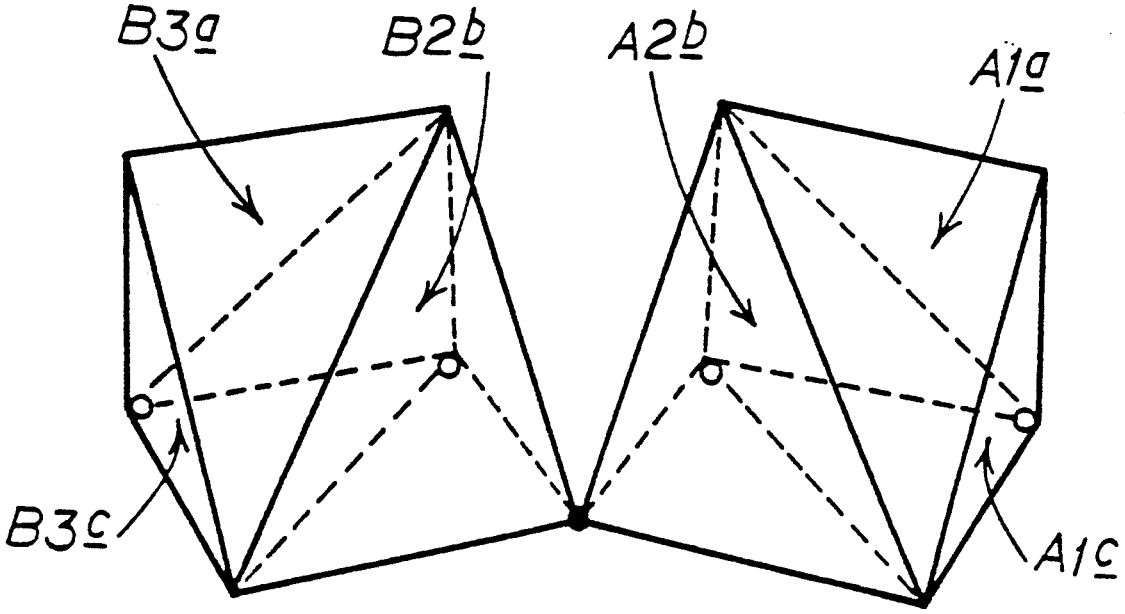
Figure 9E:
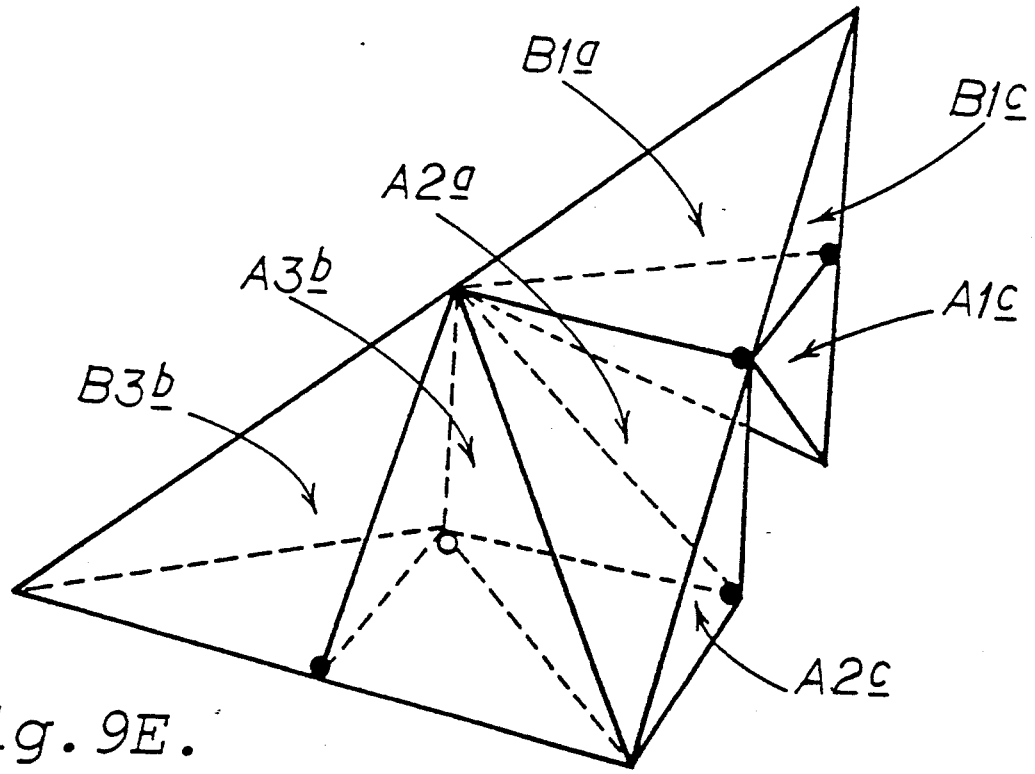
Figure 9F:
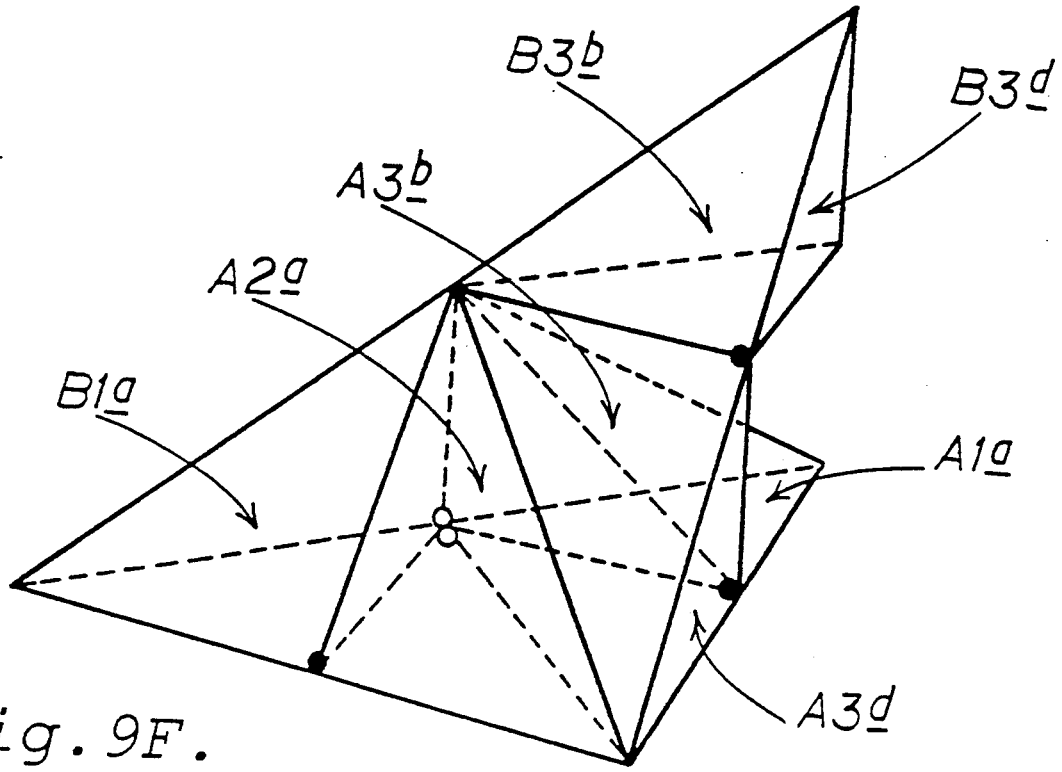
Figure 9G:
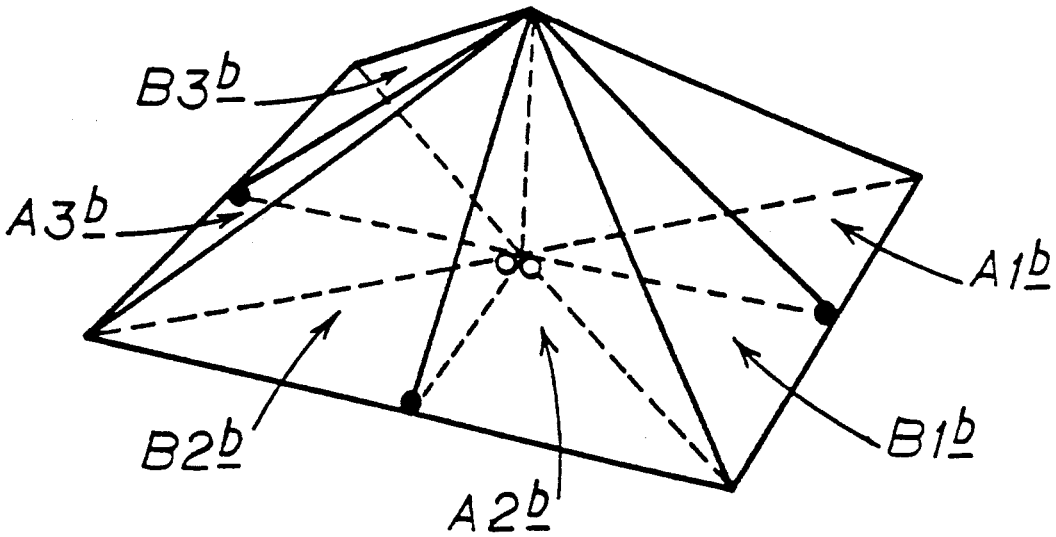
Figure 9H:
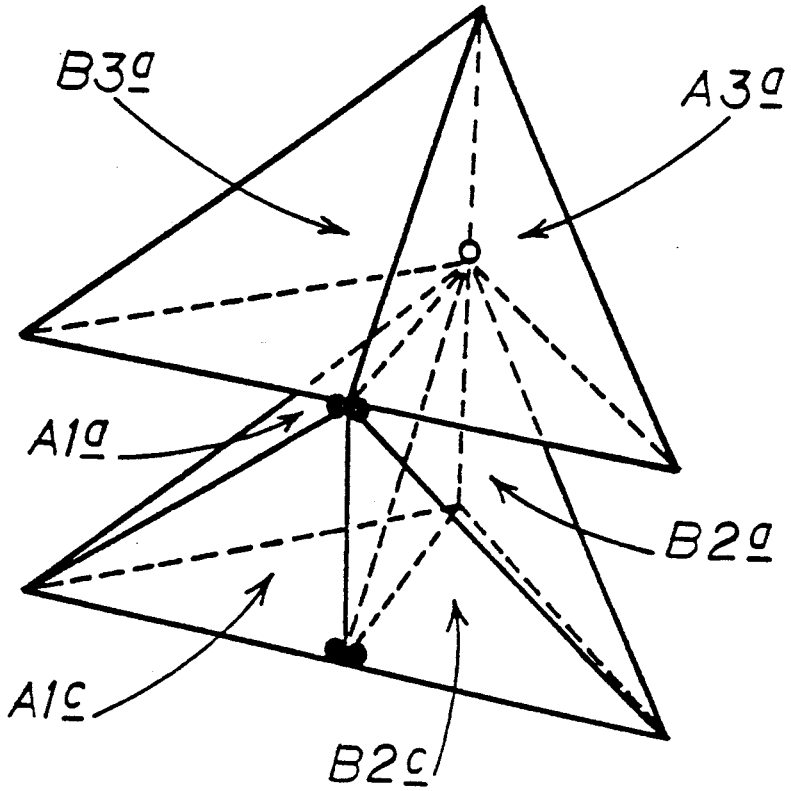
Figure 9I:
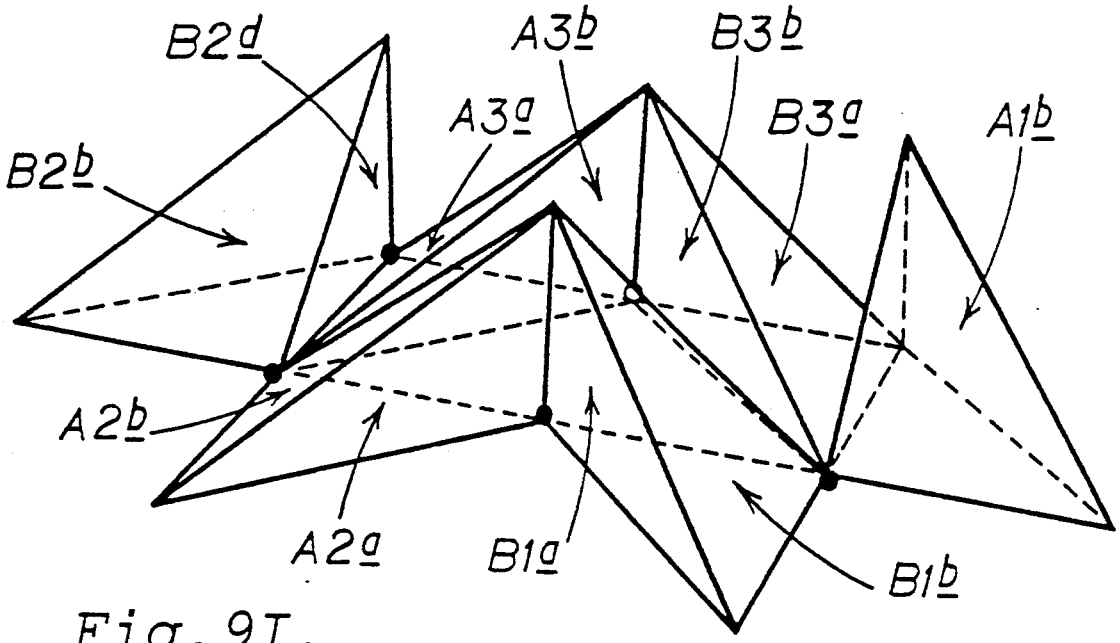
Figure 9J:
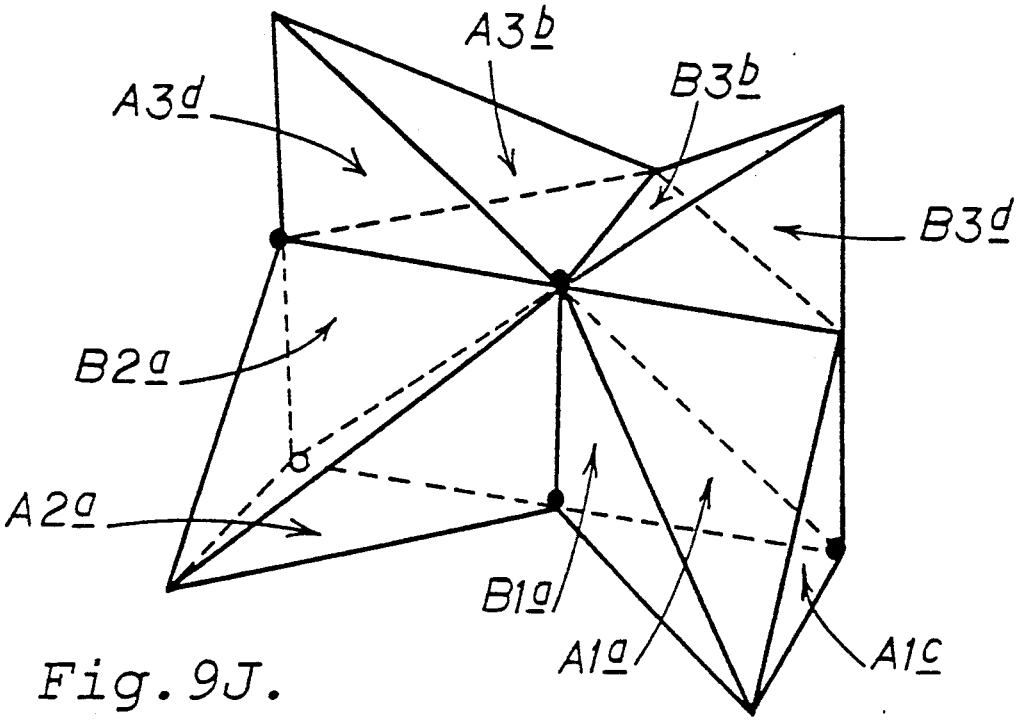

Some other interesting configurations which are formed using a partial device consisting of the six units located at the left end of the device 95 of FIG. 4. The partial device has a unique configuration of a cube of side length L. FIGS. 9A through 9C show some of the steps toward the formation of such a cube. In FIGS. 9A through 9J and all of the drawings that follow, the faces of the units constructing each configuration that can be seen are shown while, the hidden faces are not indicated by reference number. The configuration of FIG. 9A is obtained by positioning unit A1 with unit B1, unit A2 with unit B2, and unit A3 with unit B3 in the same manner shown in FIG. 8D. The next step shown in FIG. 9B is obtained by bringing the face B2a into contact with the face A3a. FIG. 9C shows the configuration of the cube which is obtained by bringing the faces A1a and B3a into contact with each other. This step also brings the faces B1a and A2a into contact with each other. FIG. 9D shows the configuration of two similar halves of the cube connected with one joint. FIGS. 9E through 9J show other interesting configurations obtained from the partial device using 6 units and 5 joints.

Figure 10A:
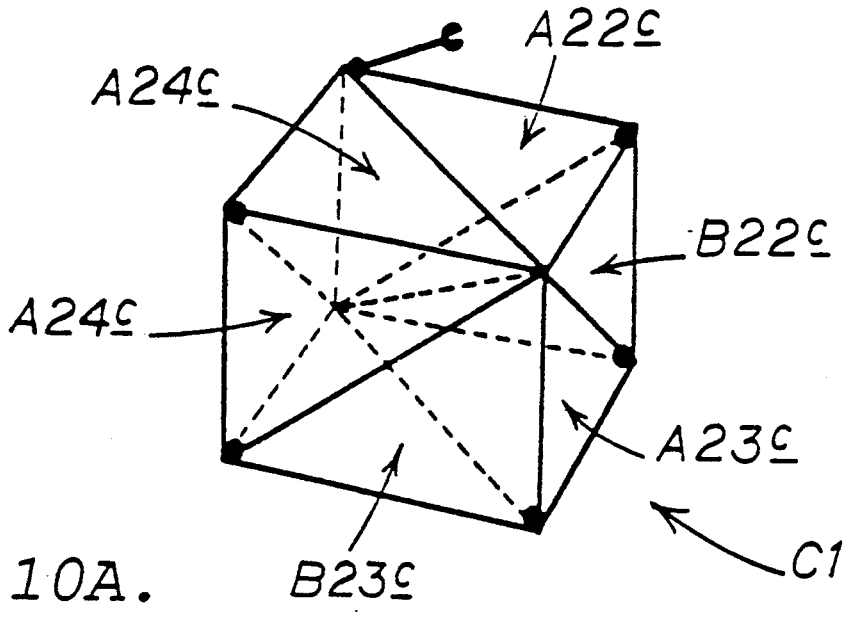
Figure 10B:
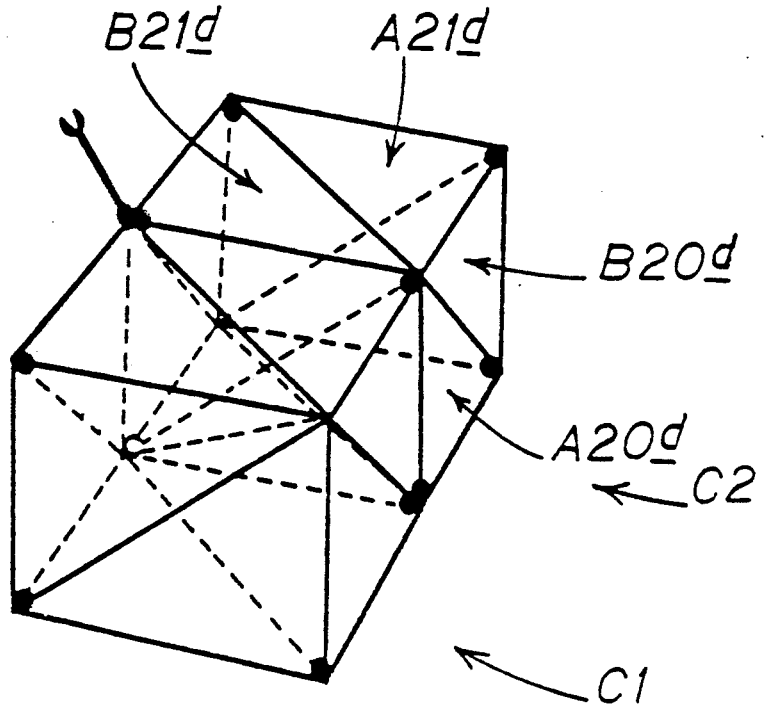
Figure 10E:
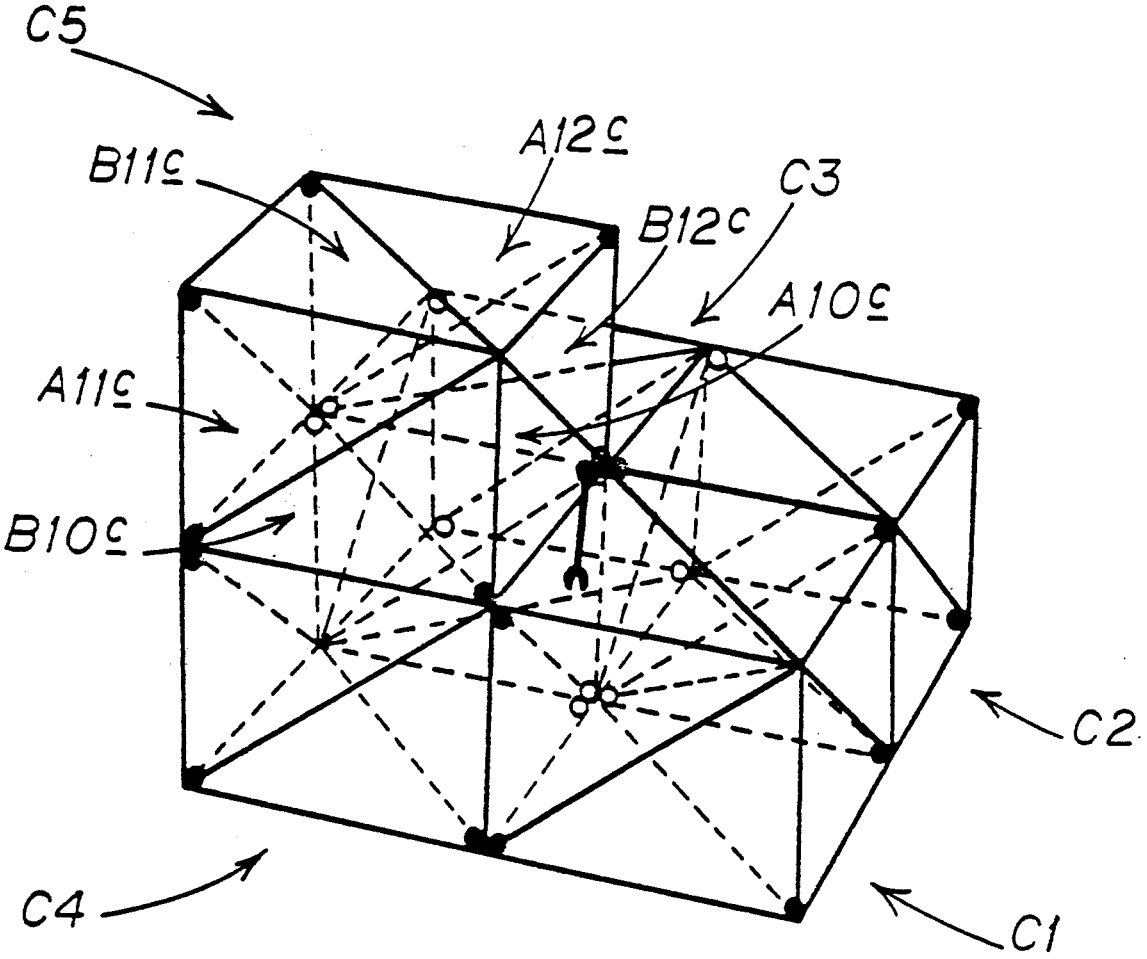
Figure 10F:
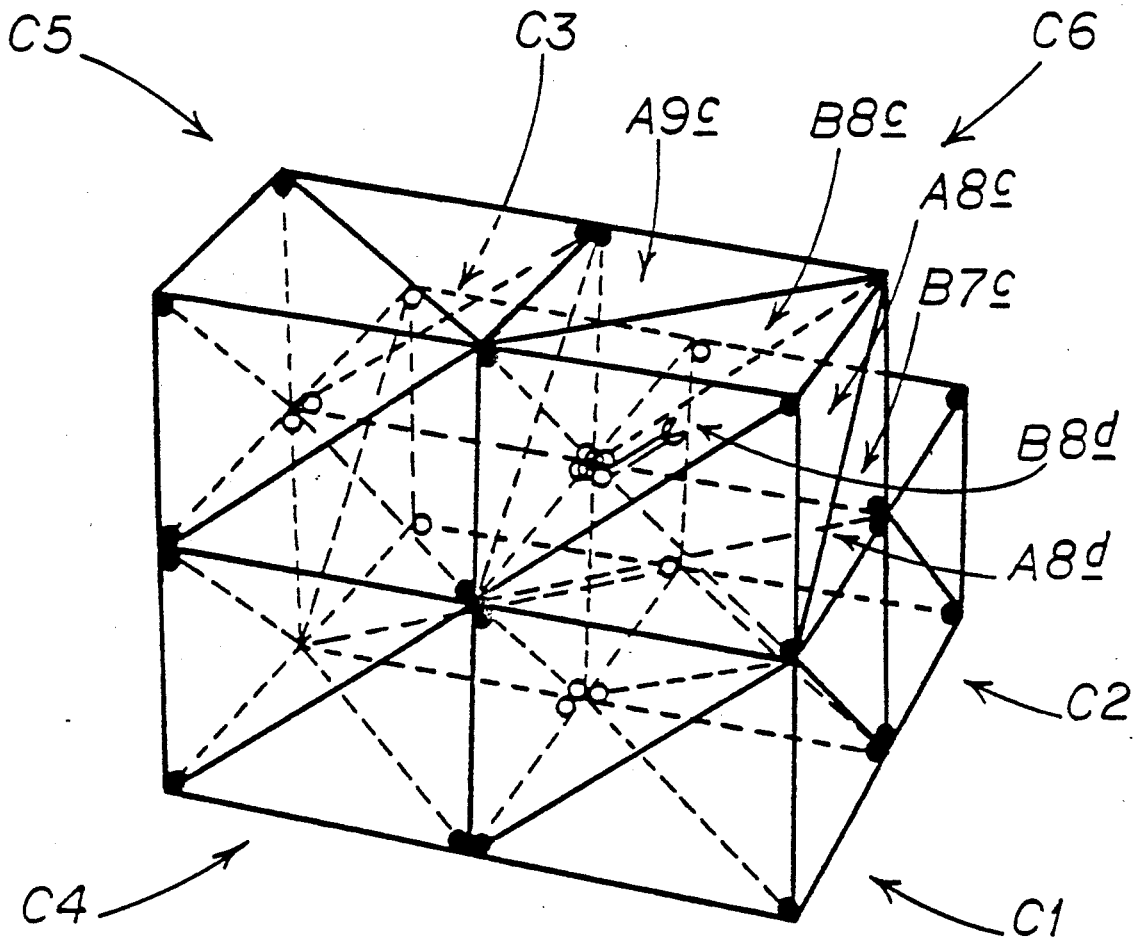
Figure 10G:
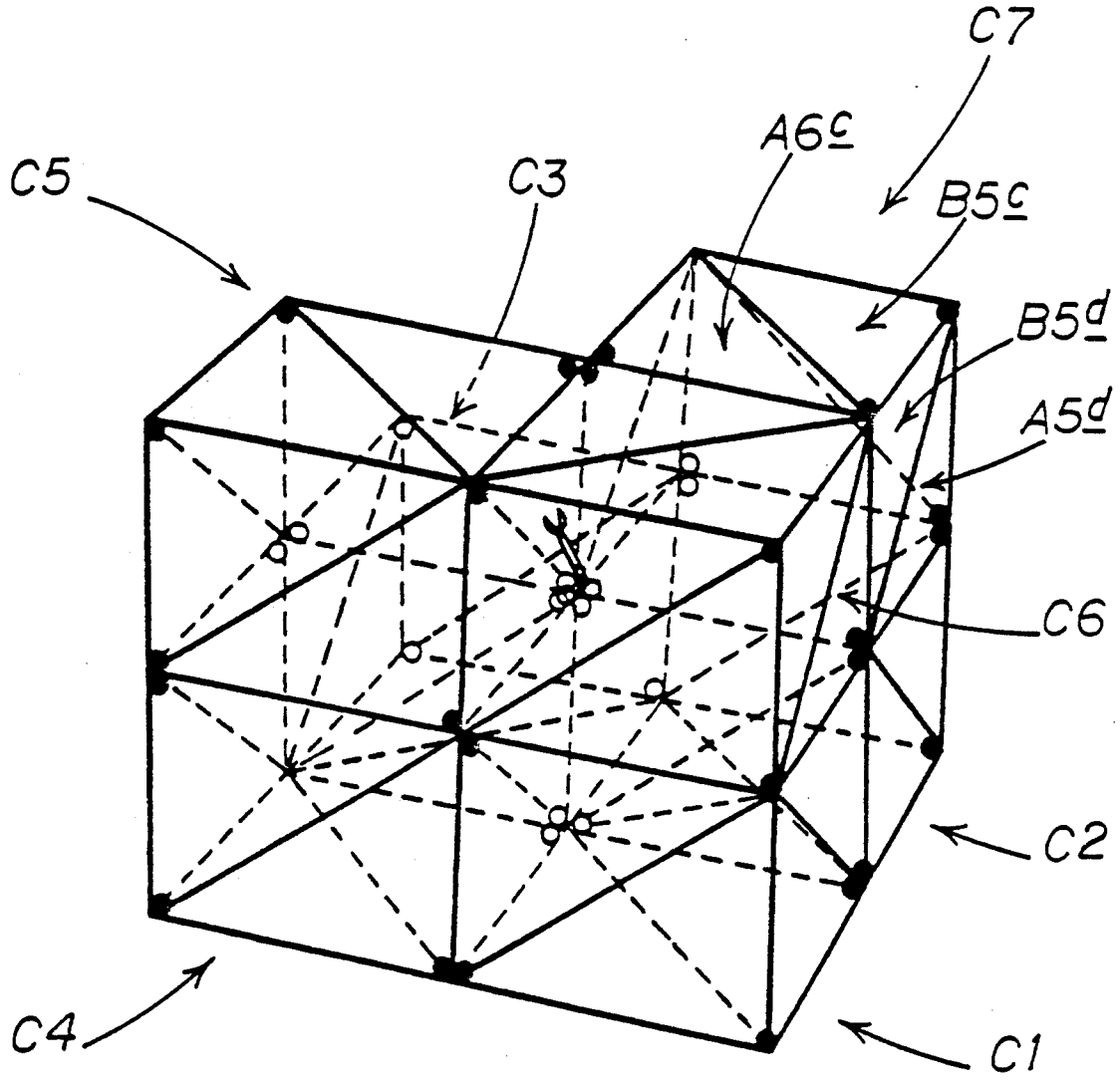
Figure 10H:
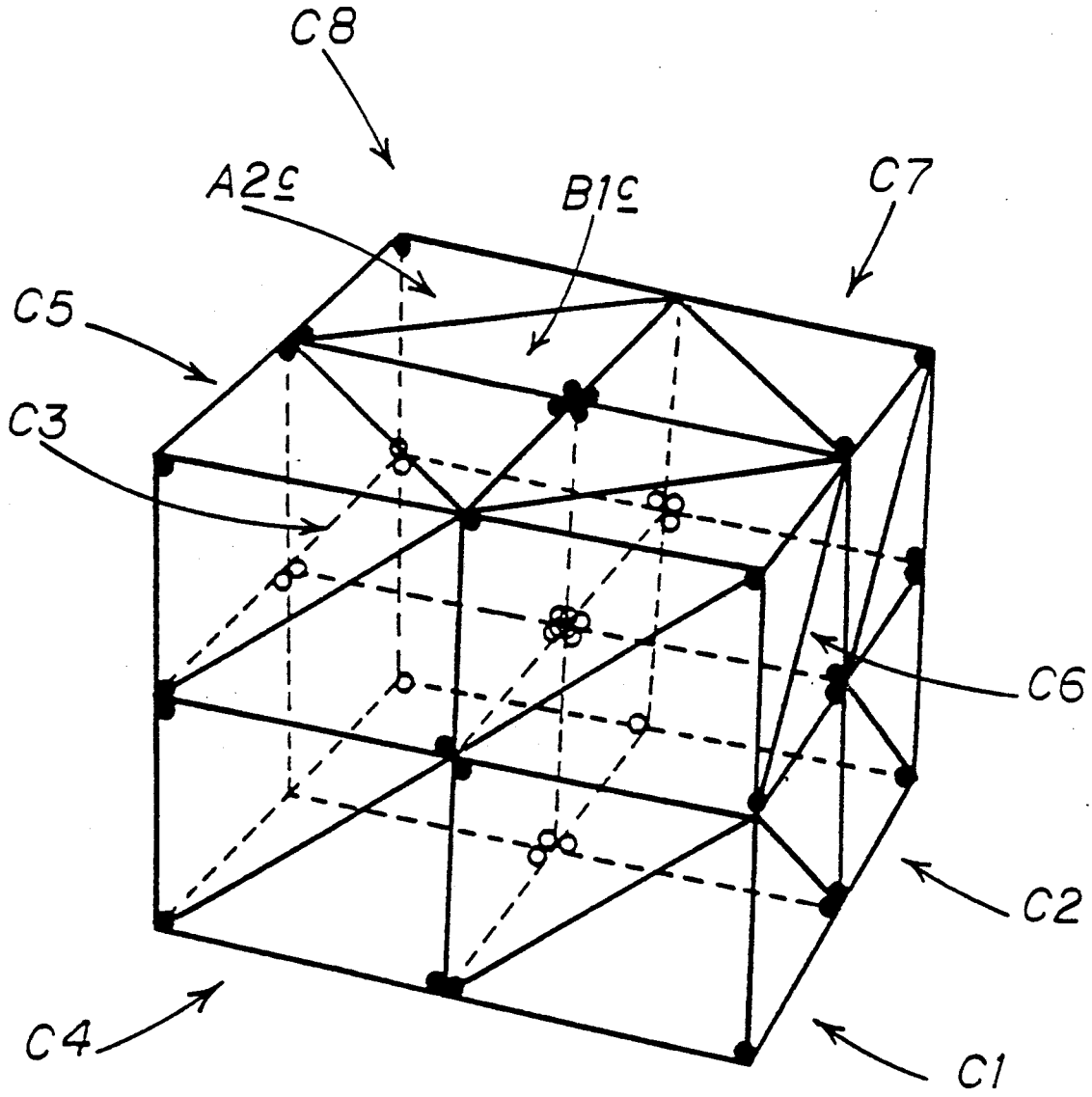

In the following a solution is presented for the puzzle of forming the configuration of a cube of side length 2L using the chain-like device 95 of FIG. 4. FIGS. 10A through 10H show different configurations which are formed during the steps required to form the cube. The cube of side length 2L includes eight identical smaller cubes each of side length L, indicated by C1, C2. . . . . , C8. The cube Cl shown in FIG. 10A is formed by folding the six rightmost units of the device 95 of FIG. 4. Each following cube appearing in the drawings of FIGS. 10B through 10H is formed using the next consecutive six units of the device. The free arm in each figure represents the connection point to the remainder of the device which is not shown in the drawings for more clear visualization. In order to form any of the eight cubes, the steps shown in FIGS. 9A through 9C may be followed. FIG. 10H shows the complete cube of side length 2L. All the surfaces of the cube are complete, and the cube is solid, i.e., there is no space unoccupied by units inside its structure.

FIG. 11 presents a solution of the puzzle to form the configuration of a four-sided pyramid using the device 95 of FIG. 4. FIGS. 11A through 11K show different configurations which are formed during the steps required to form the pyramid. The pyramid having four similar triangular side faces, each face is inclined with an angle of generally 45 degrees from the base. The height of the pyramid is 2L. The base of the pyramid is a square of side length 4L.

Figure 11A:
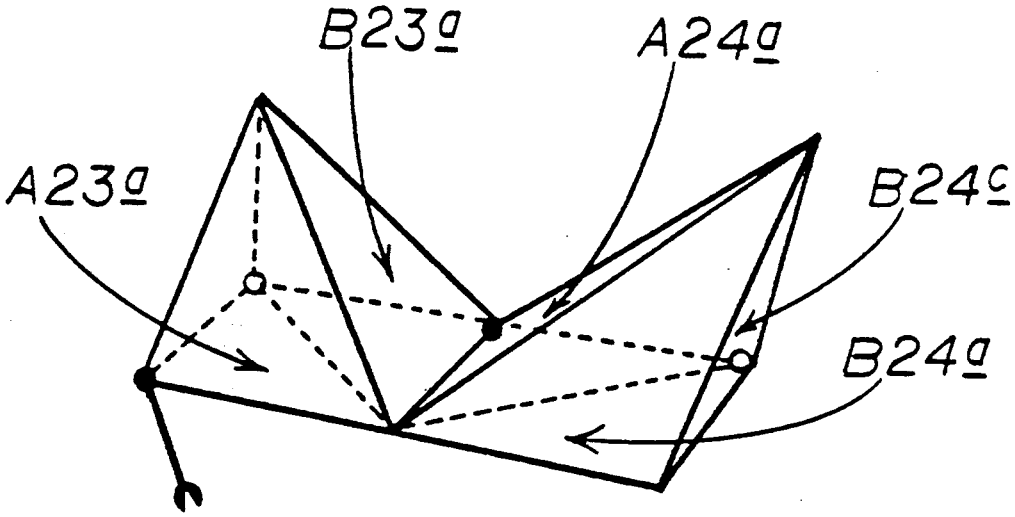
FIGS. 11A–11K show some configurations formed in the intermediate steps required to form the four-sided pyramid (shown in FIG. 7) using the articulated device 95 shown in FIG. 4.
Figure 11B:
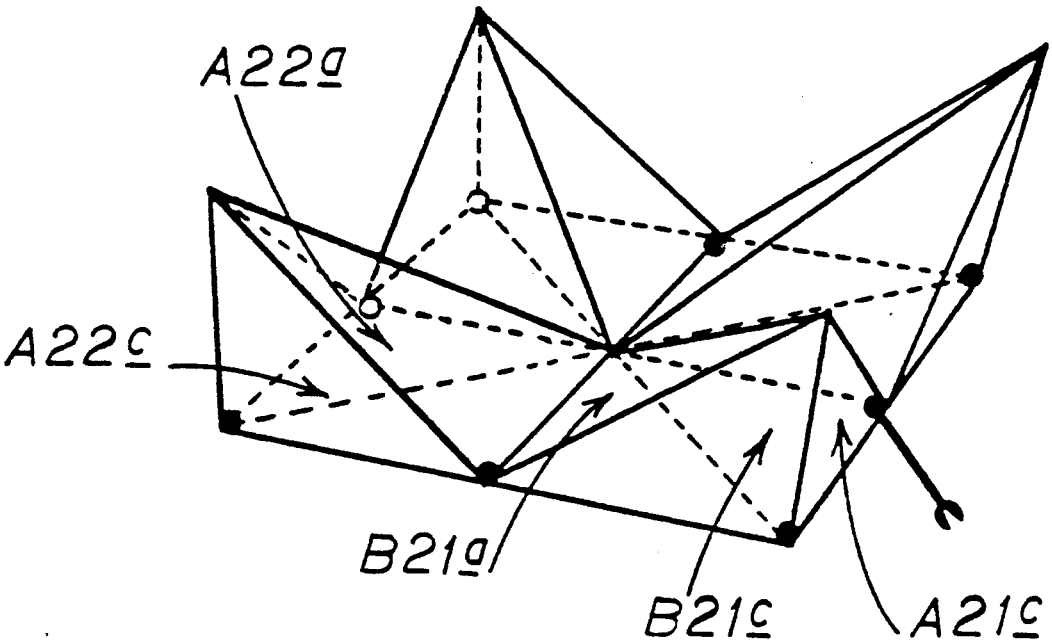
Figure 11C:
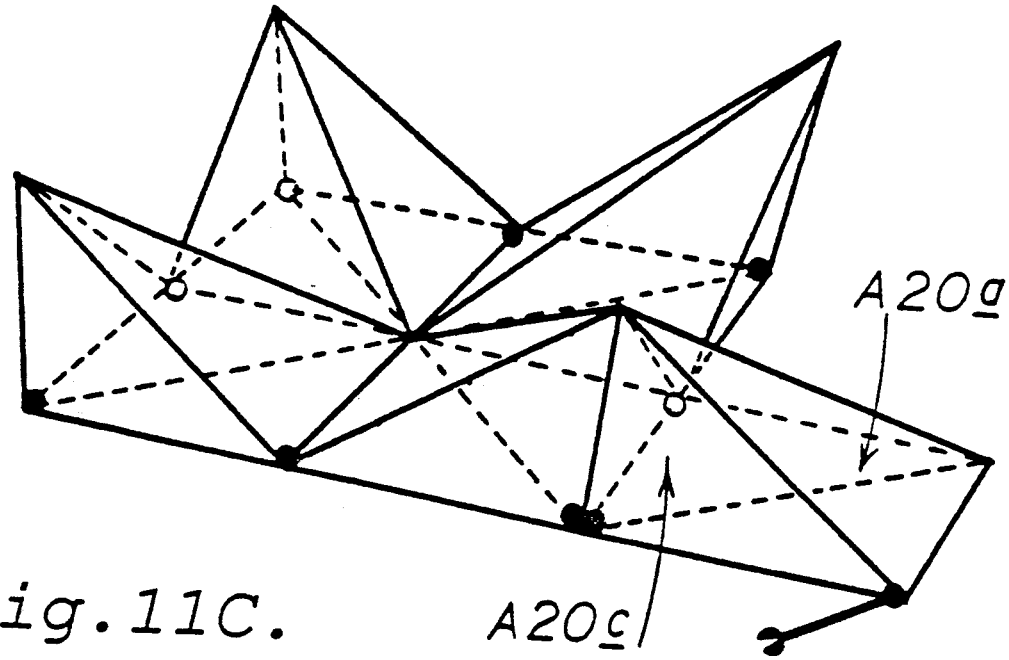
Figure 11D:
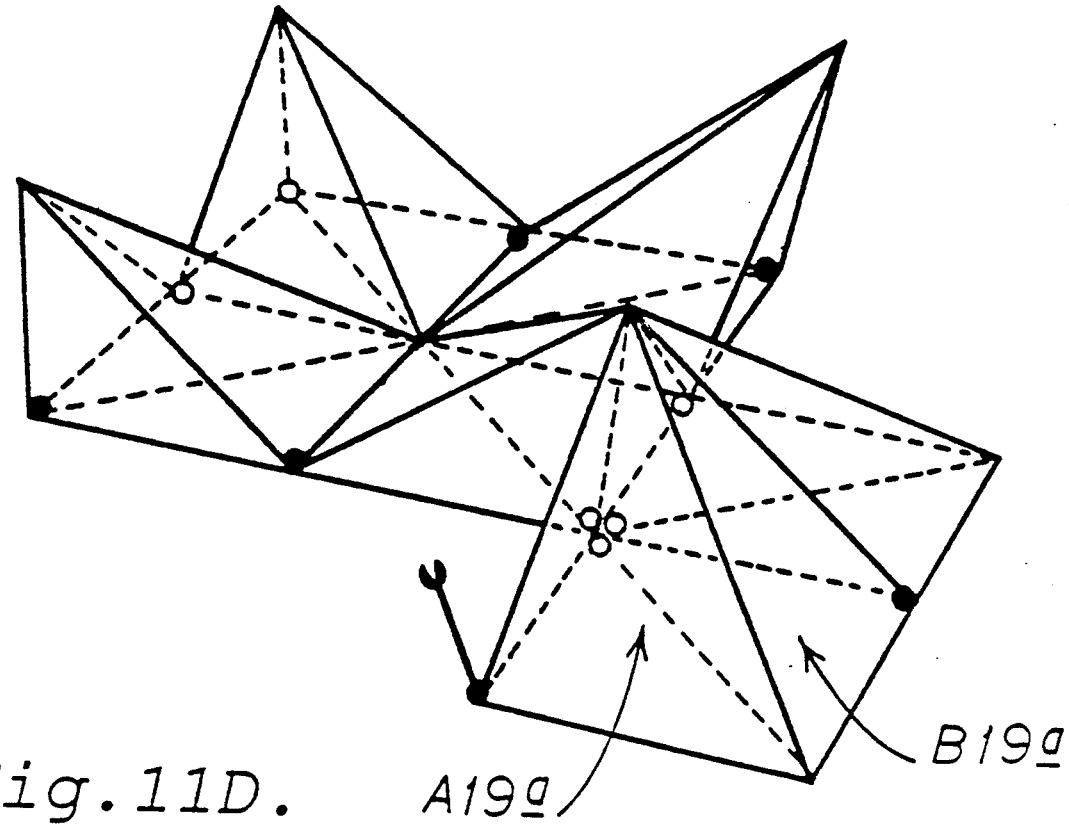
Figure 11E:
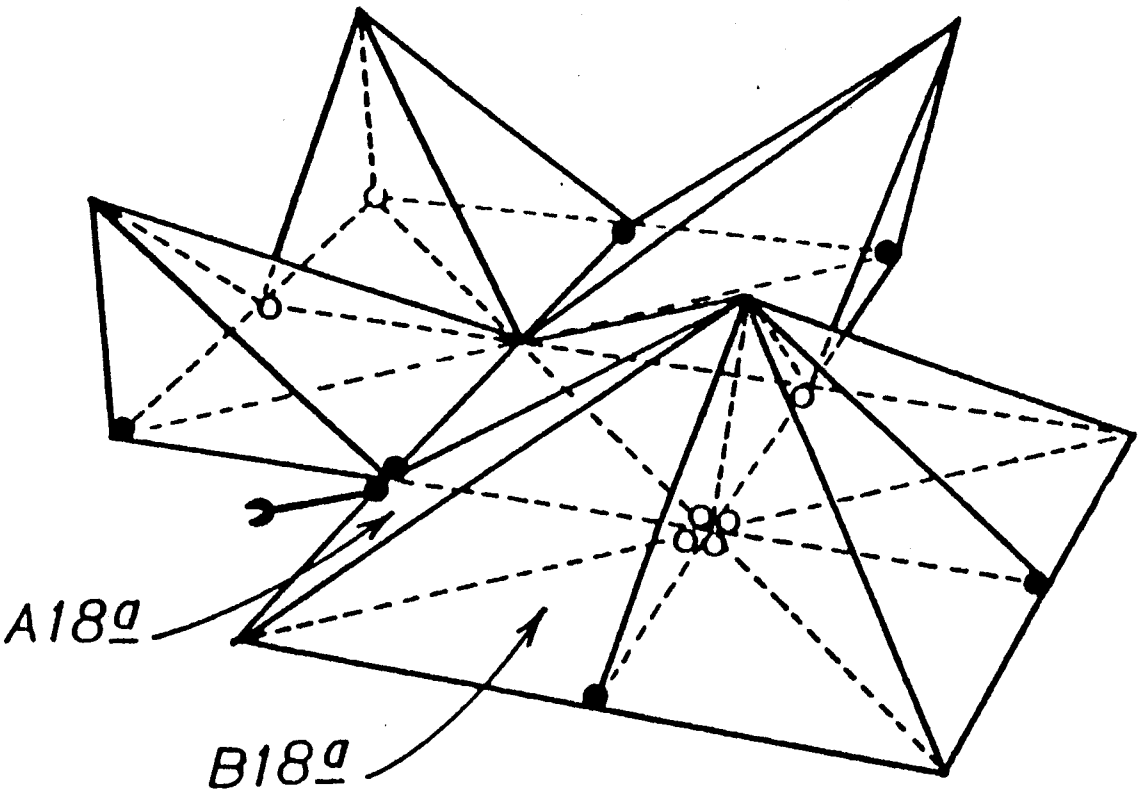
Figure 11F:
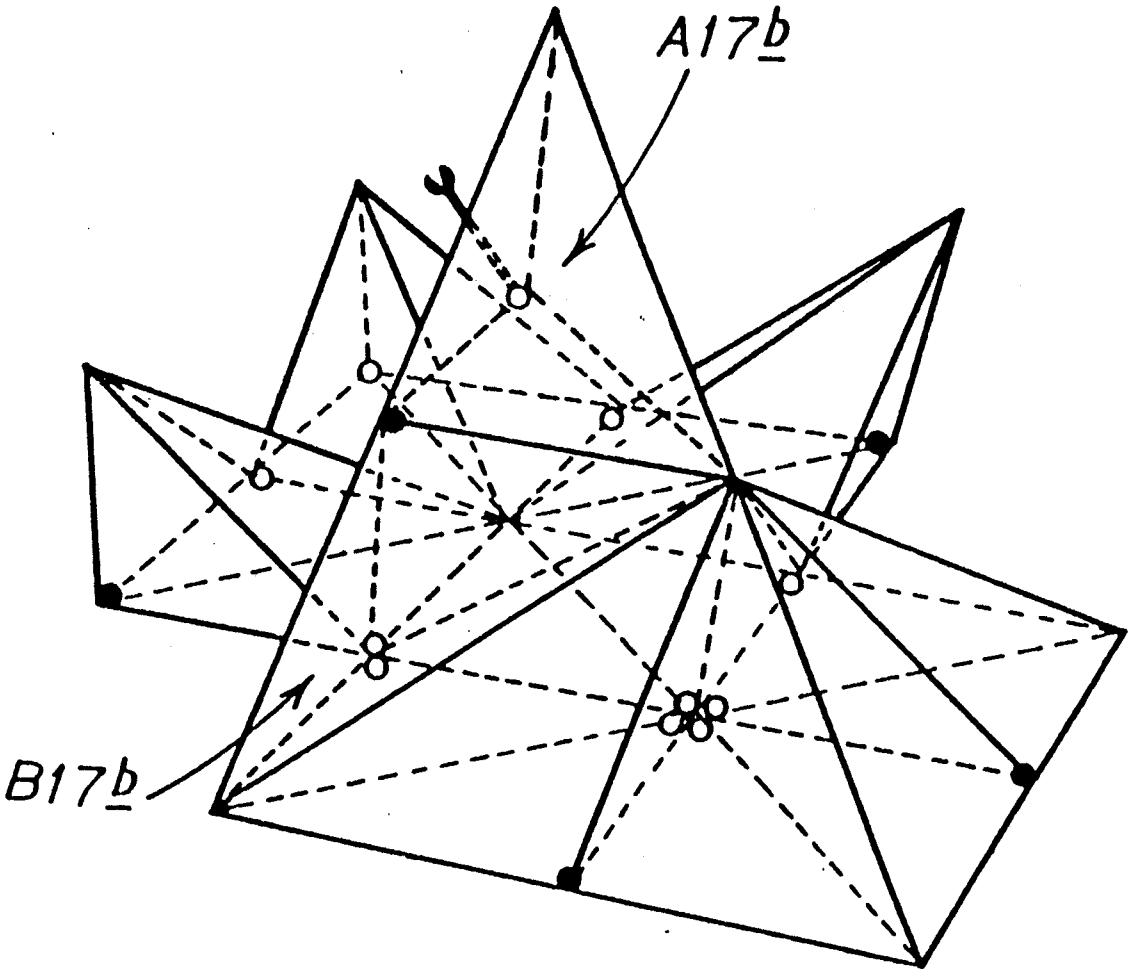
Figure 11G:
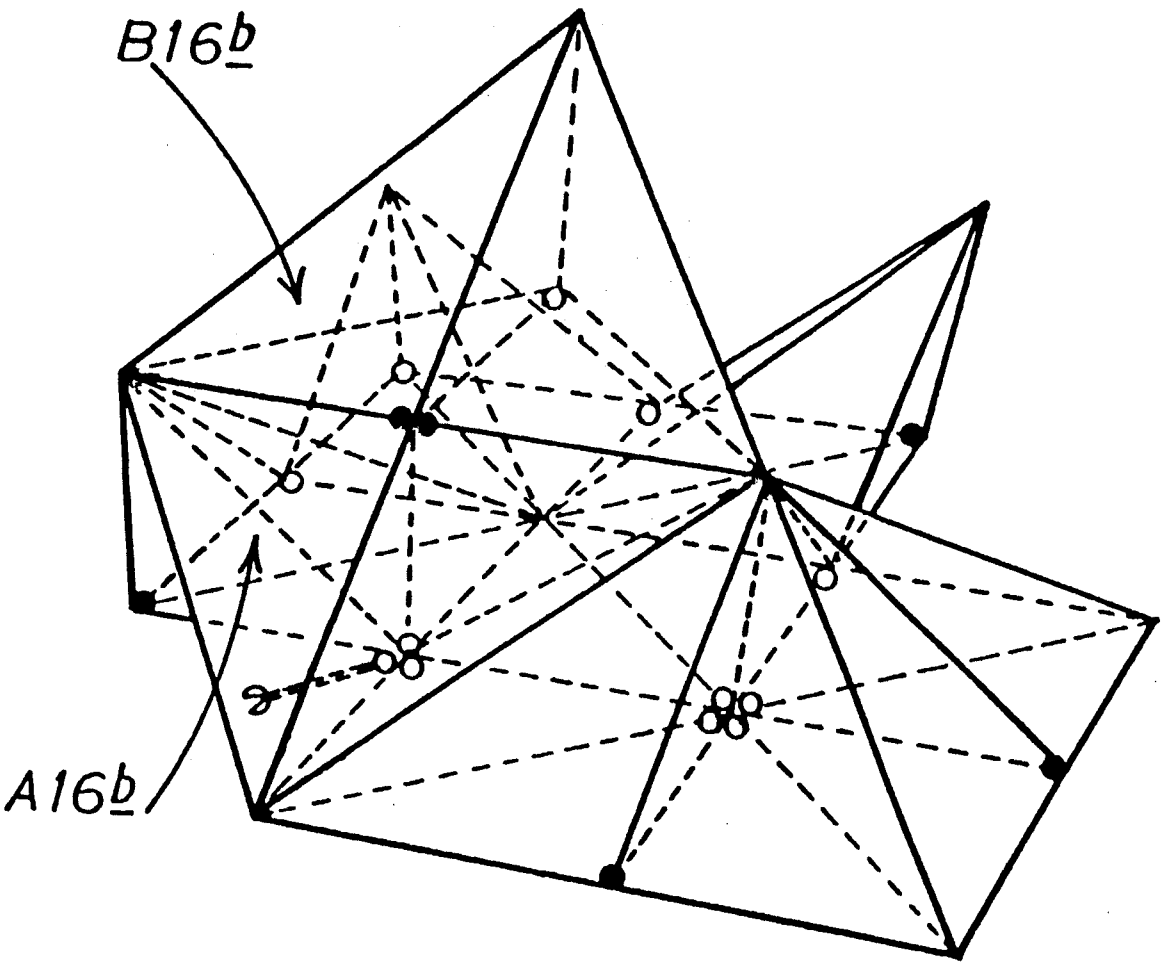
Figure 11H:
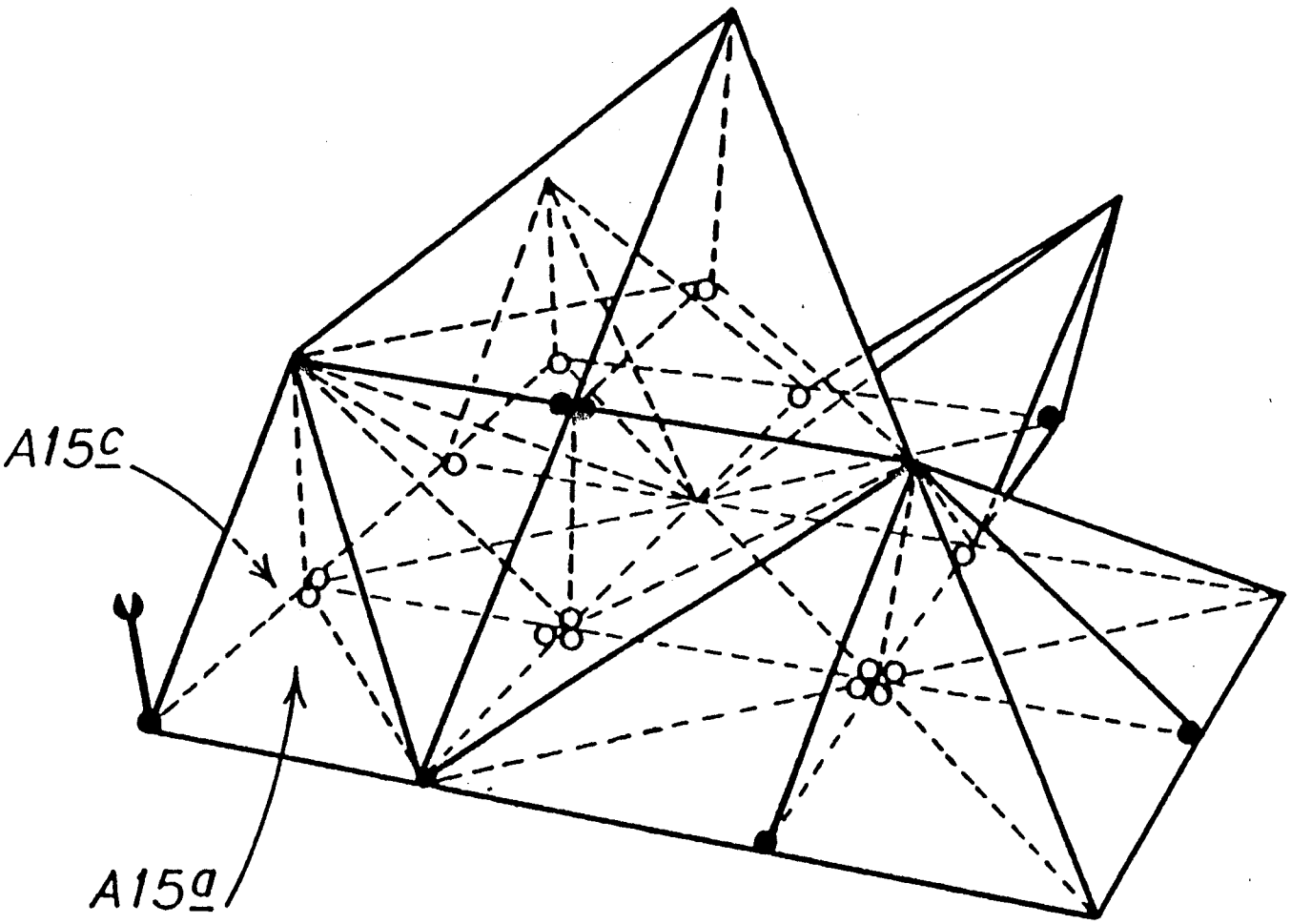
Figure 11I:
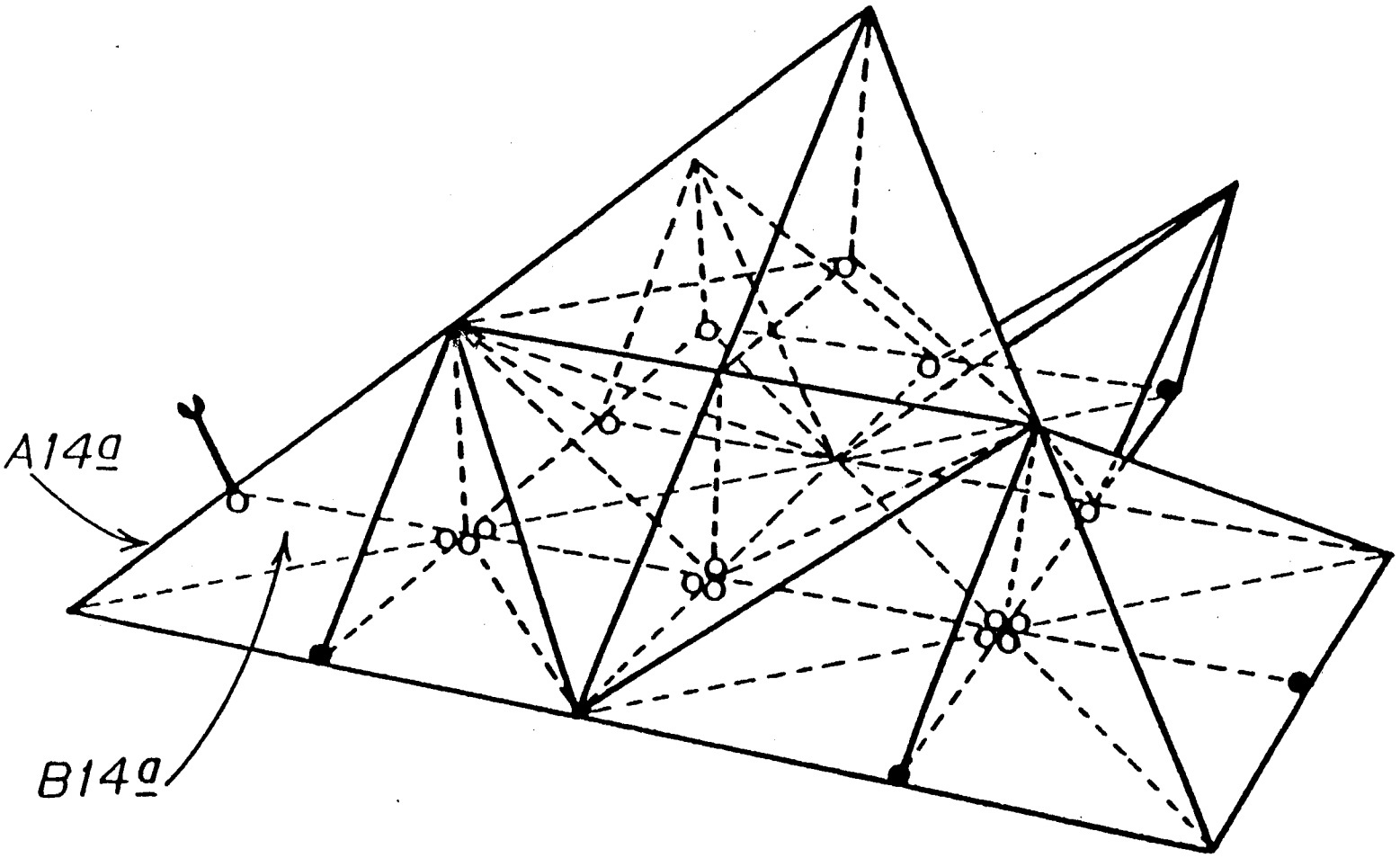
Figure 11J:
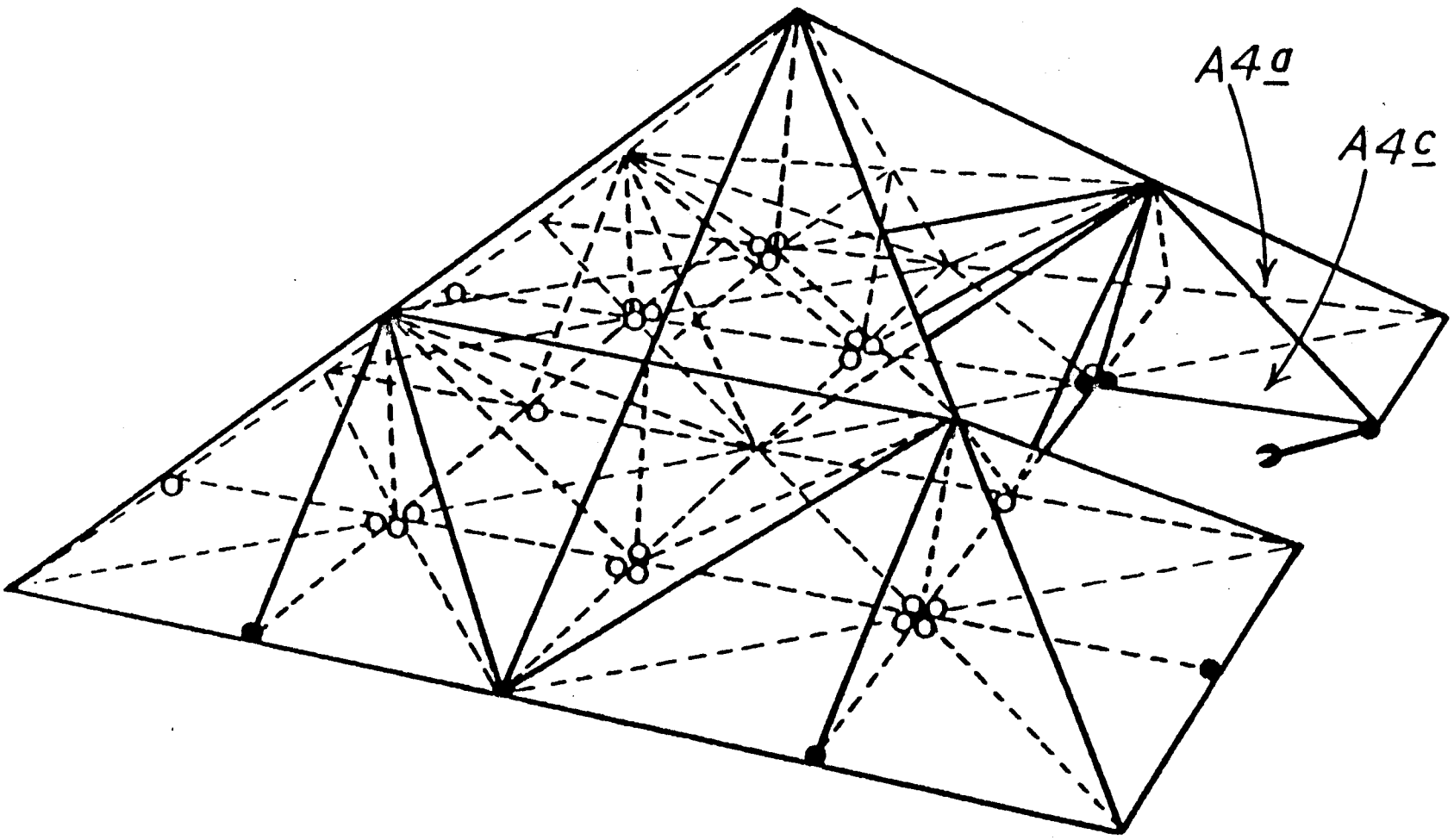
Figure 11K:
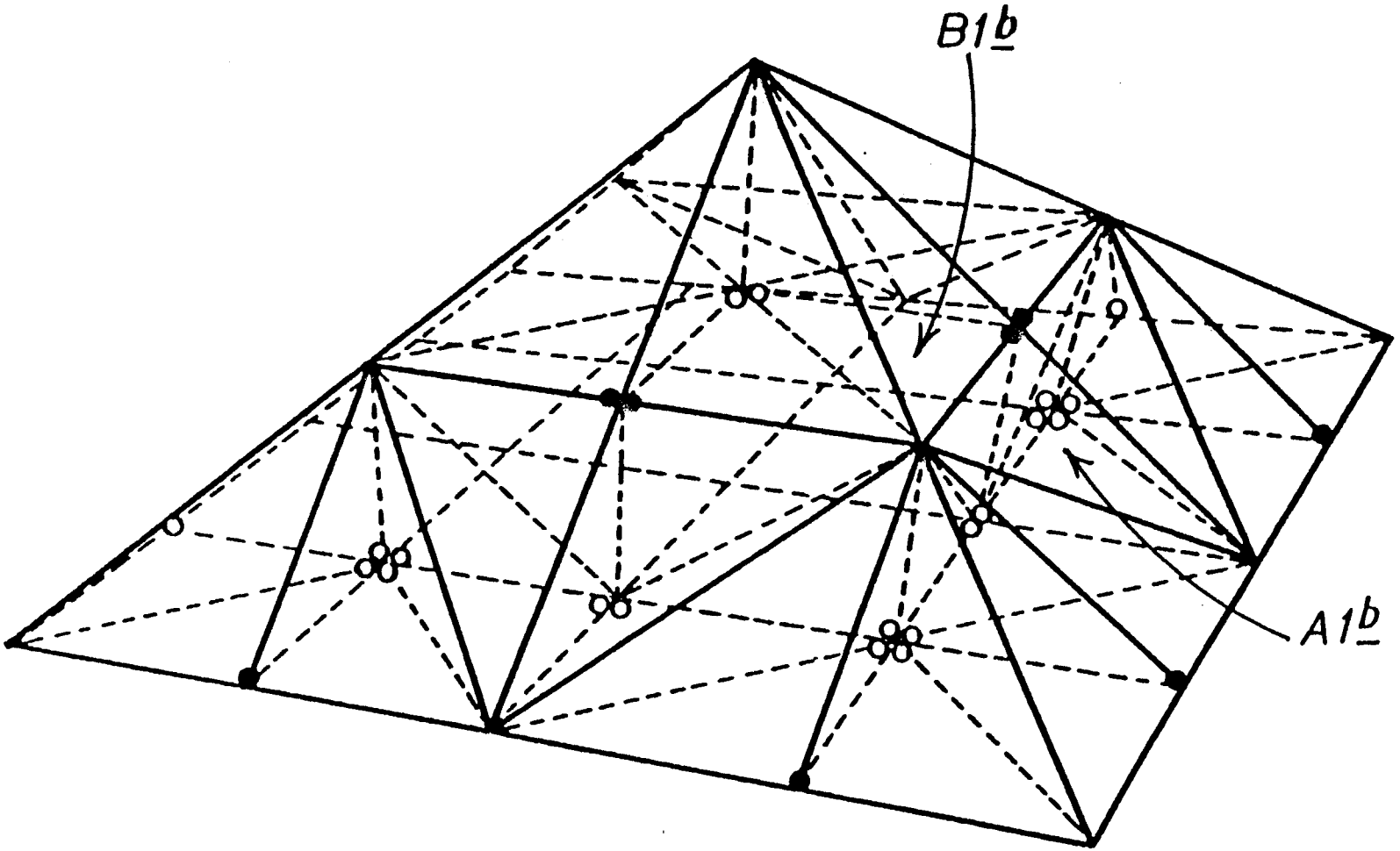

Some of the steps toward forming the pyramid are shown sequentially in the FIGS. 11A through 11K. For better visualization the full chain device 95 is not always shown, instead the last joint J in a partial chain is shown to indicate where the remainder of the units would be connected. In many uses of a device 95, or an embodiment having other numbers of units, the chain will be kept whole during the construction of various configurations. FIG. 11A shows an arrangement for the rightmost four units of the device 95. FIG. 11B shows an arrangement of rightmost eight units of the device 95. In the drawings of FIGS. 11C through 11I, is shown the arrangements obtained by adding two units to the partial device shown in the preceding drawing. FIG. 11I shows one complete face of the pyramid. FIG. 11J shows the configuration obtained after completing three side faces of the pyramid. Each of the second and third side faces of the pyramid are constructed by repeating the steps shown in FIGS. 11E through 11I. The fourth side face is constructed by repeating the steps shown in FIGS. 11E through 11G. FIG. 11K shows the complete four-sided pyramid.

The above description presents solutions for folding the device 95 into a cube of side length 2L and into a four-sided pyramid of height 2L with a square base of side length 4L. As has been mentioned, the volume of the unoccupied space inside the pyramid after being constructed is equal to the volume of sixteen units. An interesting feature of the pyramid puzzle is that all units of the articulated device 95 are located in the five surfaces of the pyramid. Such a fact can be used as a clue for the steps required to obtain the pyramid configuration.

Figure 12A:
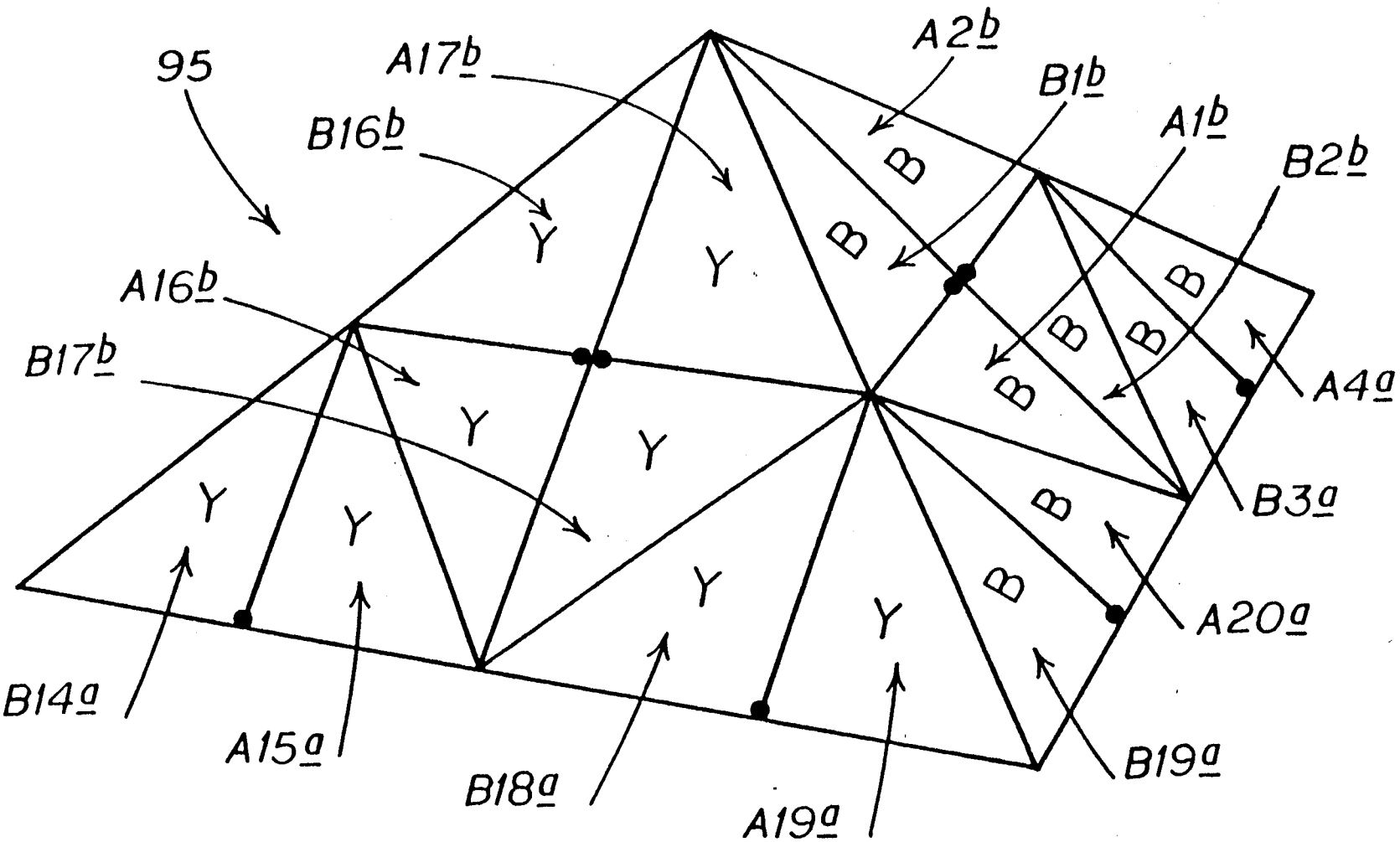
FIG. 12A shows two side faces of the four-sided pyramid using a coloring code. All surfaces of the units contributing to the pyramid faces are indicated by respective numbers in the articulated chain.
Figure 12B:
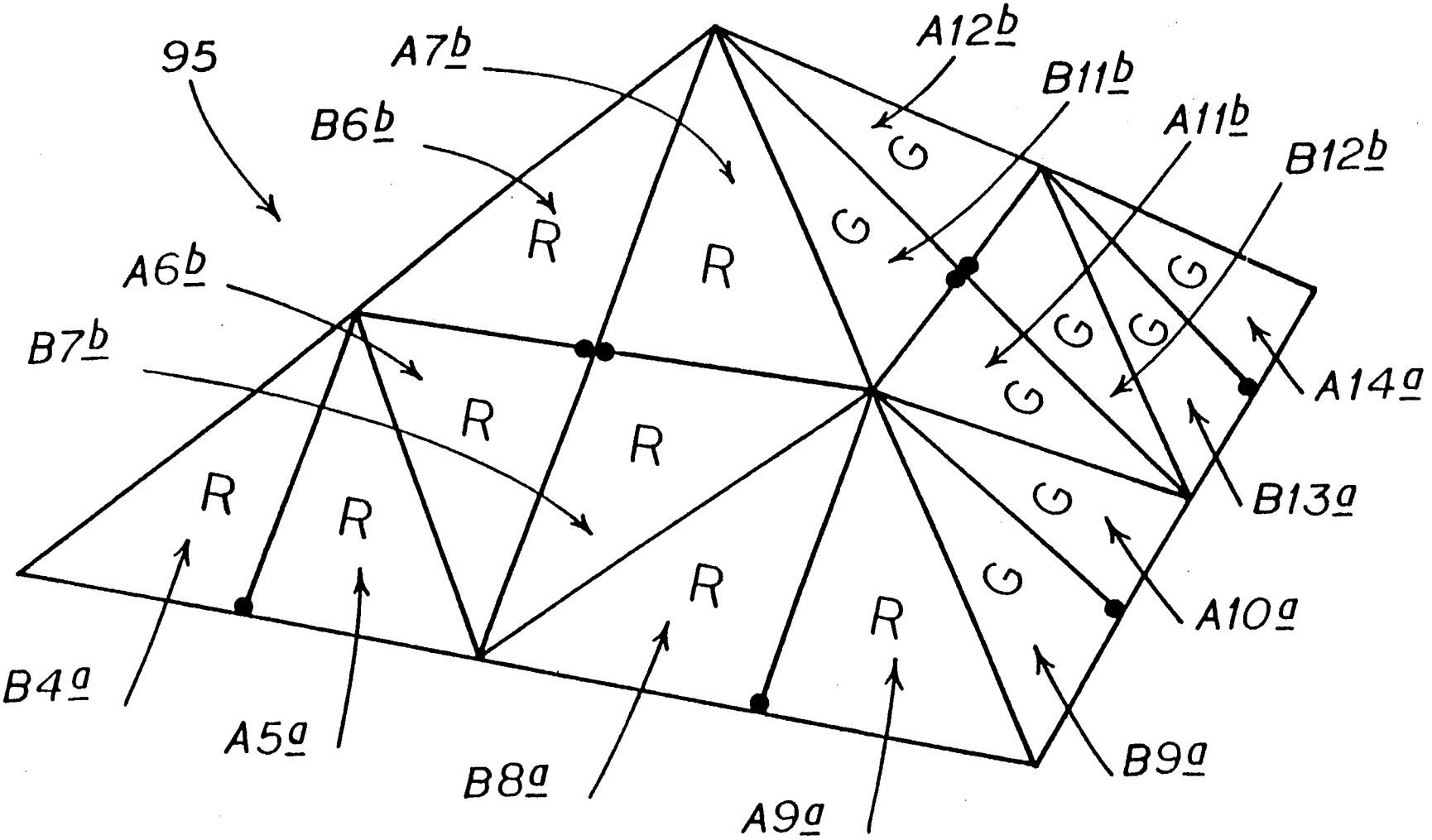
FIG. 12B shows the two sides of the pyramid opposite those shown in FIG. 12A.

The pyramid puzzle can be greatly simplified by using coloring and/or numbering scheme for selected faces of each unit in the articulated device. One preferred coloring scheme is described here. The coloring scheme is to use five different colors in the manner such that one color for each of the four side faces of the pyramid, and the fifth color for the pyramid base and for all of the units surfaces which do not appear in the pyramid surfaces. FIG. 12A shows two side faces of the pyramid with the colors yellow, referred to by Y, and blue, referred to by B. FIG. 12B shows the other two side faces of the pyramid with the colors green, referred to by G, and red, referred to by R. The fifth color for the rest of all of the units surfaces is chosen to be white. FIGS. 12A and 12B also indicate all of the units surfaces contributing to the construction of four side faces of the pyramid. Thus, by choosing the described coloring scheme, all five surfaces of the pyramid have different colors while all outer surfaces of the cubes have only one color. In this scheme the color of the outer surfaces of all cubes is white. Each side face of the four-sided pyramid is constructed of the triangular faces with sides (L, $\sqrt{2}$ L, $\sqrt{3}$ L), while each face of the cube as well as the base of the pyramid is constructed of the triangular faces with sides (L, L, $\sqrt{2}$ L).

As has been mentioned, because of the combination of rotation of the joint's arm inside the cylindrical hole of the unit and pivoting of one arm in the joint around the other arm, it is possible for any two connected units in the device 95 to rotate and pivot relative to each other in all possible directions and angles. Such a design allows any of the three faces surrounding one arm to be in full contact with any of the other three faces surrounding the other arm of the joint (see FIGS. 8D–8F). It also provides an infinite number of interesting configurations for the articulated device 95 besides being a manipulative cube-pyramid puzzle. The connection points between different units can be designed differently from the described design, where in addition to the connection pattern of all units of the device through the right corners, a connection pattern through the sharp corners or combination of both patterns can be designed for different puzzles at different levels of complexity. Using the above described type right tetrahedrons permits such configurations to be constructed from both point connected joints and edge hinged connections.

In addition to the simplicity of the structure of the articulated device of the invention, it pertains to an important feature of being expandable. By increasing the number of units included in the presently preferred device 95 of the invention, keeping the same order of connection between different units, a larger number of interesting configurations can be obtained. The most interesting configurations of such a device with larger number of units are a larger cube and a larger pyramid. A cube of side length 3L and a four-sided pyramid of height 3L with base of side length 6L can be obtained using an articulated device similar to the device 95 with one hundred and twenty-eight units. The two tables below show different configurations for cubes and pyramids obtained from the articulated device of the invention and the number of units needed for each configuration. It is clear that such a device with a larger number of units may form different puzzles with higher degree of complexity and challenge. In fact there is no upper limit in the increase of the number of units in the articulated device in order to obtain a larger cube and a larger pyramid.

It will thus be apparent that a unique puzzle and amusement device which has a wide range of uses is provided. For example, part of the device consisting of six units or more can be built in a larger scale and can be made of light material to be suitable for children's playground-type equipment. Such a device provides a child with an exciting and pleasing toy which stimulates his/her creativity and imagination and teaches him/her about more complicated geometric configurations. On the other hand the device can be built on a hand-held scale so as to be a puzzle toy. The device can also be used for decorating purposes with different sizes where a wide choice of building material can be used such as light metal, wood, plastic, and glass.

Thus, while a preferred embodiment of the invention and solutions for the cube-pyramid puzzle have been described and illustrated herein, it is possible that certain variations and modifications may be made and other solutions may be provided without departing from the spirit of the invention. The following tables show other presently preferred embodiments.

| CUBE CONFIGURATIONS | | |
|---|---|---|
| TYPE | SIDE LENGTH | NUMBER OF UNITS |
| Solid | L | 6 |
| Hollow | 2L | 32 |
| Solid | 2L | 48 |
| Hollow | 3L | 90 |
| Solid | 3L | 162 |
| Hollow | 4L | 166 |
| Solid | 4L | 384 |

| PYRAMID CONFIGURATIONS | | |
|---|---|---|
| TYPE | HEIGHT* | NUMBER OF UNITS |
| Solid | L | 8 |
| Hollow | 2L | 48 |
| Solid | 2L | 64 |
| Hollow | 3L | 128 |
| Solid | 3L | 216 |
| Hollow | 4L | 272 |
| Solid | 4L | 512 |

*The side length of the square base is equal to twice the height of the pyramid.

I claim:

1. A puzzle game device capable of manipulation into various configurations comprising:

a plurality of three dimensional polygon units having multiple exterior faces that intersect forming points;

a plurality of joint means for connecting said units at two of said points on each of said units into a chain-like arrangement;

said joints providing for relative movement of said units to form geometric configurations by interconnecting said faces; and said units comprising right tetrahedrons having four faces each face with a generally right angle; and said four faces arranged so as to form two right points.

2. The puzzle game device of claim 1 wherein each of said right tetrahedrons is comprised of two faces having side lengths generally equal to (L, $\sqrt{2}$ L, $\sqrt{3}$ L); and two faces having side lengths generally equal to (L, L, $\sqrt{2}$ L).

3. The puzzle game device of claim 2 wherein said joint means connects said right tetrahedrons at said right points.

4. The puzzle game device of claim 3 wherein the respective faces of each of said units is colored to represent its position within the formed geometric configurations.

5. The puzzle game device of claim 2 wherein said units comprise two different shaped units alternately arranged and where said different shaped units are mirror image right tetrahedrons.

6. The puzzle game device of claim 5 wherein said joint means connect said right tetrahedrons at said right points.

7. The puzzle game device of claim 6 wherein said plurality of units includes 6 units and said plurality of joints includes 5.

8. The puzzle game device of claim 6 wherein said plurality of units includes 8 units and said plurality of joints includes 7.

9. The puzzle game device of claim 6 wherein said plurality of units includes 32 units and said plurality of joints includes 31.

10. The puzzle game device of claim 6 wherein said plurality of units includes 48 units and said plurality of joints includes 47.

11. The puzzle game device of claim 10 wherein the respective faces of each of said units is colored to represent its position within the formed geometric configurations.

12. The puzzle game device of claim 11 wherein the formed geometric configuration includes a four sided pyramid having a square base;

said faces forming the four sides of such pyramid are of a first, second, third, and fourth color respectively, and said faces forming the base of such pyramid is a fifth color.

13. The puzzle game device of claim 12 wherein said formed geometric configuration also includes a cube and the exterior sides of such cube are said fifth color.

14. The puzzle game device of claim 6 wherein said plurality of units includes 64 units and said plurality of joints includes 63.

15. The puzzle game device of claim 6 wherein said plurality of units includes 90 units and said plurality of joints includes 89.

16. The puzzle game device of claim 6 wherein said plurality of units includes 128 units and said plurality of joints includes 127.

17. The puzzle game device of claim 6 wherein said plurality of units includes 162 units and said plurality of joints includes 161.

18. The puzzle game device of claim 6 wherein said plurality of units includes 166 units and said plurality of joints includes 165.

19. The puzzle game device of claim 6 wherein said plurality of units includes 216 units and said plurality of joints includes 215.

20. The puzzle game device of claim 6 wherein said plurality of units includes 384 units and said plurality of joints includes 383.

21. The puzzle game device of claim 6 wherein said plurality of units includes 272 units and said plurality of joints includes 271.

22. The puzzle game device of claim 6 wherein said plurality of units includes 512 units and said plurality of joints includes 511.

23. The puzzle game device of claim 6 wherein each of said right tetrahedrons is comprised of two faces having side lengths generally equal to ($L$, $\sqrt{2}L$, $\sqrt{3}L$); and two faces having side lengths generally equal to ($L$, $L$, $\sqrt{2}L$).

24. The puzzle game device of claim 1 wherein said joint means provides for each unit to be positioned relative to each adjacent unit such that any face on said unit forming one of said two points can be placed in contact with any face forming the respectively connected other of said two points on said adjacent unit.

25. The puzzle game device of claim 24 wherein said joint means comprises:

a central joint positioned between two extending arms; and bores in said units extending inwardly at said two points.

26. The puzzle game device of claim 25 further including:

each of said arms having two spaced hemispherical shaped end portions at the ends opposite said central joint; and said bores having an enlarged volume at the interior end of said bore for receiving said end portions.

27. The puzzle game device of claim 26 wherein said central joint includes a hinge joint.

28. The puzzle game device of claim 27 wherein said units comprise:

right tetrahedrons having four faces each with a generally right angle; and said four faces arranged so as to form two right points.

29. The puzzle game device of claim 28 wherein said units comprise alternately arranged mirror image right tetrahedrons.

30. The puzzle game device of claim 29 wherein said joint means connect said right tetrahedrons at said right points.

31. The puzzle game device of claim 1 wherein the respective faces of each of said units is colored to represent its position within said formed geometric configurations.

32. The puzzle game device of claim 31 wherein the formed geometric configuration includes a four sided pyramid having a square base;

said faces forming the four sides of such pyramid are of a first, second, third, and fourth color respectively, and said faces forming the base of such pyramid is a fifth color.

33. The puzzle game device of claim 32 wherein said formed geometric configuration also includes a cube and the exterior sides of such cube are said fifth color.

34. The puzzle game device of claim 33 wherein said units comprise:

right tetrahedrons having four faces each with a generally right angle; and said four faces arranged so as to form two right points.

35. The puzzle game device of claim 34 wherein said units comprise alternately arranged mirror image right tetrahedrons.

36. The puzzle game device of claim 35 wherein said joint means connect said right tetrahedrons at said right points.

37. The puzzle game device of claim 31 wherein the formed geometric configuration includes a cube; and said faces forming the exterior sides of such cube are of a fifth color.

38. A joinder device for interconnecting three dimensional units into a chain-like game comprising:

a central flexible joint positioned between two extending rigid arms; and each of said arms having two generally hemispherical shaped end portions at the ends opposite said central joint.

39. The joinder device of claim 38 wherein said arms intermediate said central joint and said end portions are of generally circular cross section; and said hemispherical shaped end portions form an enlargement greater than the diameter of said circular cross section of said arms.

40. The joinder device of claim 38 wherein at least said end portions of said arms are composed of a flexible material so as to be compressible to a maximum diameter generally equal to the diameter of said cross section of said arms.

41. The joinder device of claim 38 wherein said central joint is a hinged joint.

42. A puzzle game device capable of manipulation into various configurations comprising:

a serial arrangement of a plurality of units connectable together to provide relative movement of said units to form geometric configurations by interconnecting said units;

said units generally shaped as right tetrahedrons having four faces each with a generally right angle;

said four faces arranged so as to form two right points;

two of said four faces having side lengths generally equal to L, $\sqrt{2}$ L, $\sqrt{3}$ L; and two of said four faces having side lengths generally equal to L, L, $\sqrt{2}$ L where L is the length of the smallest side.

43. The puzzle game device of claim 44 wherein said units are alternately arranged mirror image right tetrahedrons.

44. The puzzle game device of claim 43 wherein said plurality of units includes 6 units.

45. The puzzle game device of claim 43 wherein said plurality of units includes 8 units.

46. The puzzle game device of claim 43 wherein said plurality of units includes 32 units.

47. The puzzle game device of claim 43 wherein said plurality of units includes 48 units.

48. The puzzle game device of claim 43 wherein said plurality of units includes 64 units.

49. The puzzle game device of claim 43 wherein said plurality of units includes 90 units.

50. The puzzle game device of claim 43 wherein said plurality of units includes 128 units.

51. The puzzle game device of claim 43 wherein said plurality of units includes 162 units.

52. The puzzle game device of claim 43 wherein said plurality of units includes 166 units.

53. The puzzle game device of claim 43 wherein said plurality of units includes 216 units.

54. The puzzle game device of claim 43 wherein said plurality of units includes 384 units.

55. The puzzle game device of claim 43 wherein said plurality of units includes 272 units.

56. The puzzle game device of claim 43 wherein said plurality of units includes 512 units.

57. The puzzle game device of claim 43 wherein the respective faces of each of said units is colored to represent its position within said formed geometric configurations.

58. The puzzle game device of claim 57 wherein the formed geometric configuration includes a four sided pyramid having a square base;

said faces forming the four sides of such pyramid are of a first, second, third, and fourth color respectively, and said faces forming the base of such pyramid is a fifth color.

59. The puzzle game device of claim 58 wherein said formed geometric configuration also includes a cube and the exterior sides of such cube are said fifth color.

60. The puzzle game device of claim 57 wherein the formed geometric configuration includes a cube; and said faces forming the exterior sides of such cube are of a fifth color.

* * * * *